United States Patent [19]

Kaneko et al.

[11] Patent Number: 4,733,591

[45] Date of Patent: Mar. 29, 1988

[54] ELECTRONIC MUSICAL INSTRUMENT

[75] Inventors: Makoto Kaneko; Susumu Kawashima, both of Hamamatsu, Japan

[73] Assignee: Nippon Gakki Seizo Kabushiki Kaisha, Hamamatsu, Japan

[21] Appl. No.: 735,365

[22] Filed: May 17, 1985

[30] Foreign Application Priority Data

| | | | |
|---|---|---|---|
| May 30, 1984 | [JP] | Japan | 59-109838 |
| Mar. 20, 1985 | [JP] | Japan | 60-56336 |
| Mar. 20, 1985 | [JP] | Japan | 60-56337 |

[51] Int. Cl.[4] ..... G10L 1/00

[52] U.S. Cl. ..... 84/1.01; 84/1.19; 84/470 R; 84/DIG. 12; 381/51

[58] Field of Search ..... 84/1.01, 1.03, 1.19, 84/1.21, 1.22, DIG. 12, 470 R; 381/51

[56] References Cited

U.S. PATENT DOCUMENTS

| | | | |
|---|---|---|---|
| 4,380,185 | 4/1983 | Holcomb | 84/DIG. 12 |
| 4,414,878 | 11/1983 | Mitarai et al. | 84/1.19 |
| 4,527,274 | 7/1985 | Gaynor | 84/1.01 |
| 4,549,867 | 10/1985 | Dittakavi | 84/470 R |

*Primary Examiner*—Russell E. Adams

*Attorney, Agent, or Firm*—Blakely, Sokoloff, Taylor & Zafman

[57] ABSTRACT

An electronic musical instrument comprises: a keyboard circuit for generating a pitch data signal which designates the note name of a musical tone to be produced; a speech signal generator for generating a speech signal which tells in human voice the name of the designated musical tone; multiplexed processing circuit for time-divisionally processing the pitch data signal and the speech signal; and sound signal producing circuit for producing the musical tone and the human voice in accordance with the processed output from the multipled processing circuit. Thus the instrument speaks the names of the tones as it produces the musical tones.

5 Claims, 15 Drawing Figures

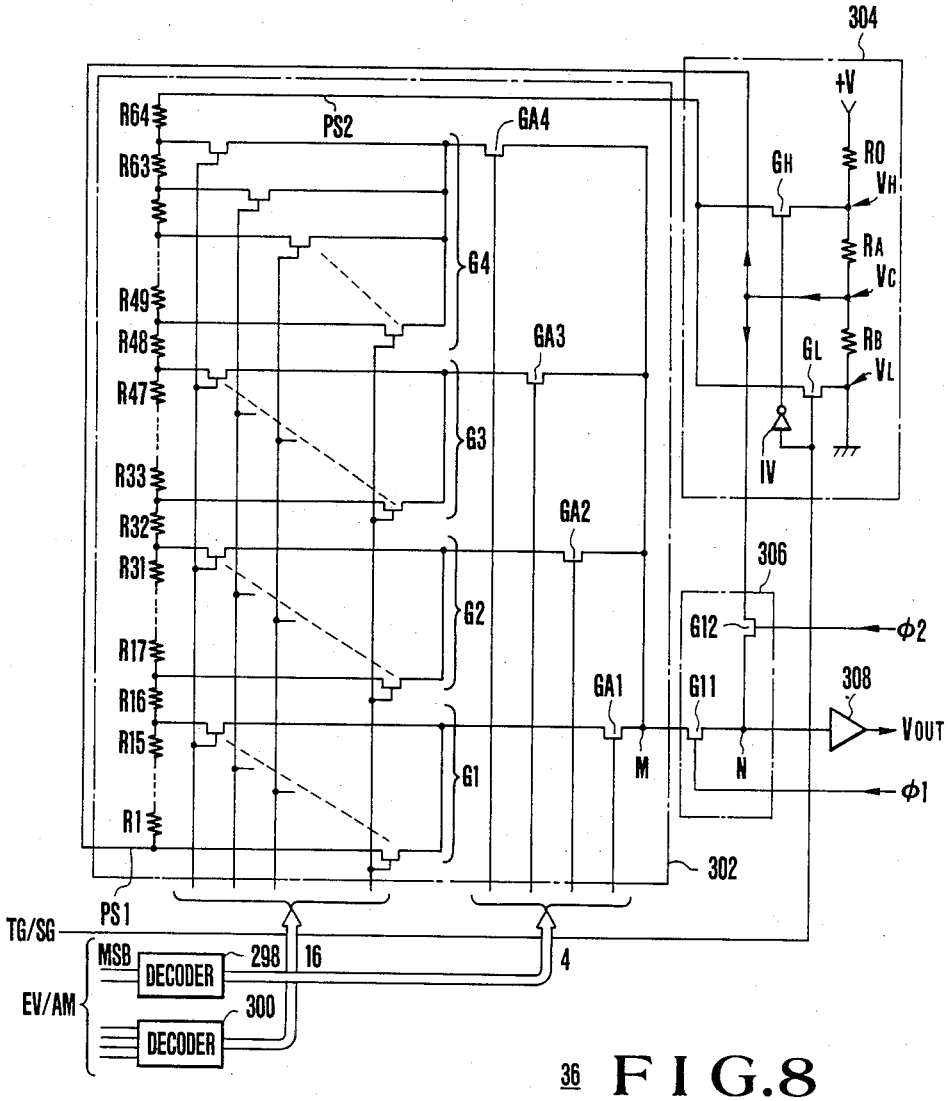
36 FIG.8

46

ELECTRONIC MUSICAL INSTRUMENT

BACKGROUND OF THE INVENTION

The present invention relates to an electronic musical instrument, and more particularly to an electronic musical instrument which speaks in human voice names of the tones being produced.

As a musical instrument for children, there has conventionally been known as electronic musical instrument which renders an analog electronic circuit to generate musical instrument tones (e.g., organ tones) corresponding to the depressed keys on a keyboard. However, the electronic musical instrument of this type simply produces musical instrument tones and results in monotonous performance, so that children become tired of playing the instrument after a short period of time.

When various functions (e.g., an automatic performance function) are added, the instrument system itself must have a large size and is costly. Such an electronic musical instrument cannot be a low-end product for children.

In addition, conventional electronic musical instruments have a complicated system configuration and cannot be manufactured at low cost.

For example, in a conventional general-purpose digital musical instrument, digital waveshape data representing a musical tone waveshape is directly supplied to a D/A converter to form an analog musical tone signal. In this case, the D/A converter receives parallel bit signals. When the number of bits is increased, the arrangement of the D/A converter becomes complicated.

Furthermore, in a conventional electronic musical instrument, waveshape data is read out from a memory at a rate corresponding to the pitch of a note to be produced and is multiplied by a multiplier with envelope data. Output data from the multiplier is converted by the D/A converter, thereby obtaining an analog musical tone signal imparted with an envelope.

According to the state-of-the-art technique described above, an additional multiplier must be provided, and the overall system configuration is complicated.

SUMMARY OF THE INVENTION

It is, therefore, a principal object of the present invention to provide an electronic musical instrument with functions to help the playing of beginners.

It is another object of the present invention to provide an electronic musical instrument suitable for children.

It is still another object of the present invention to provide a compact electronic musical instrument.

In order to achieve the above objects of the present invention, there is provided an electronic musical instrument comprising:

musical tone designating means for designating a musical tone to be produced;

human voice data designating means for designating human voice data associated with the designated musical tone;

multiplexing means for time-divisionally processing the designated musical tone and the human voice data; and means for producing the musical tone and the human voice in accordance with an output from the multiplexing means.

According to the present invention, there is also provided a digital wave to analog wave converting apparatus comprising:

converting means for converting n-bit digital waveshape data to m-bit (where $m<n$) digital waveshape data;

a digital/analog converter for converting the m-bit digital waveshape data generated from the converting means to an analog signal; and gate means arranged at an output side of the digital-/analog converter, the converting means including means for selecting out of the n-bit digital waveshape data m-bit data consisting of consecutive m bits beginning with the bit which is next to consecutive "0"s within top l bits of the n-bit digital waveshape data and downward bits therefrom, and the gate means including control means for controlling an ON time of a gate in accordance with the number of the consecutive "0"s.

BRIEF DESCRIPTION OF THE DRAWINGS

FIG. 8 is a circuit diagram of a D/A converter in the electronic musical instrument shown in FIG. 1;

DESCRIPTION OF THE PREFERRED EMBODIMENT

Figure 1:
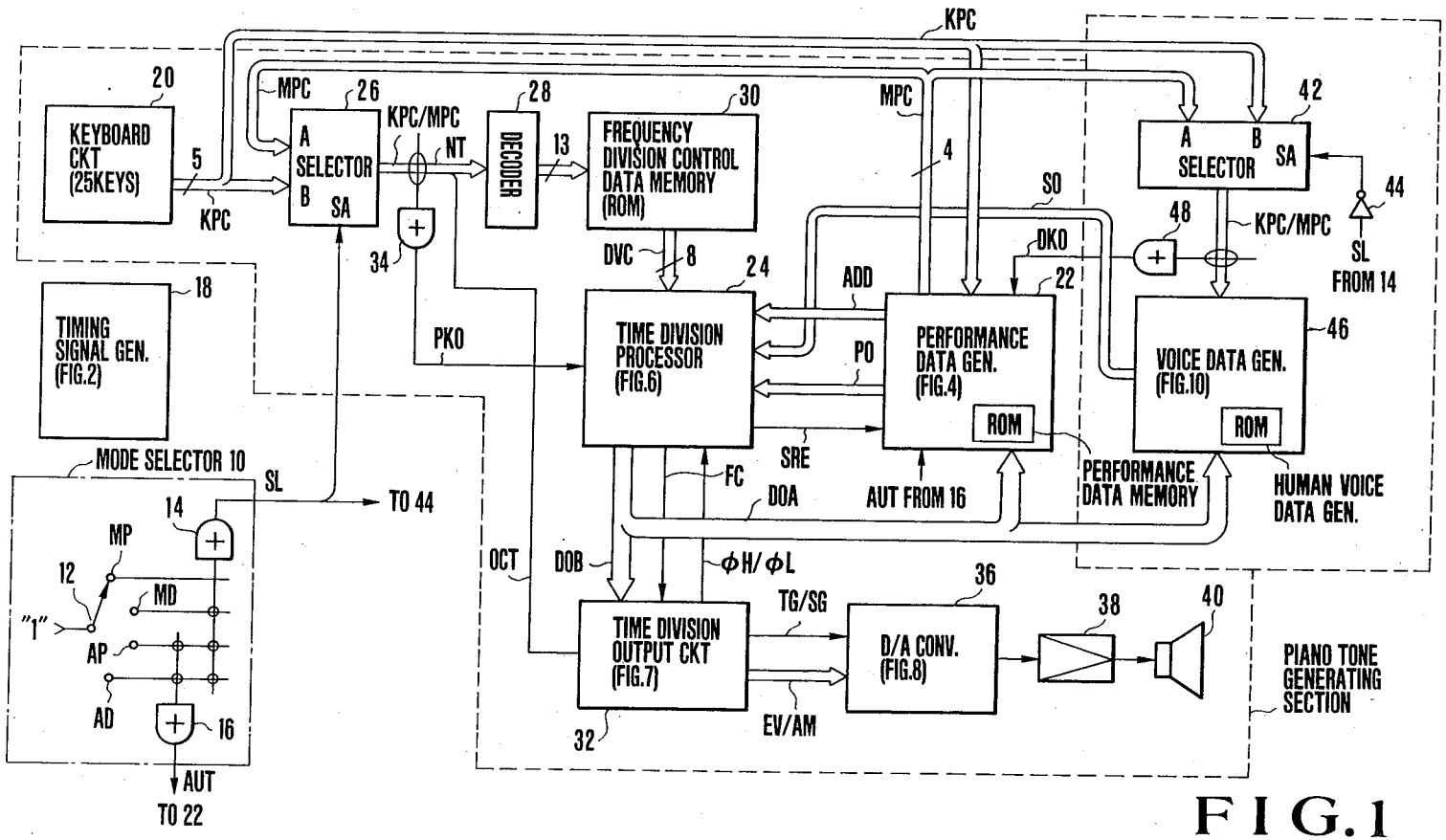
FIG. 1 is a block diagram showing a circuit arrangement of an electronic musical instrument according to an embodiment of the present invention.

FIG. 1 shows an electronic musical instrument according to an embodiment of the present invention. This electronic musical instrument can select one among a manual piano mode, a manual speech mode, an auto piano mode and an auto speech mode. The contents of these modes are given as follows:

(1) Manual Piano Mode

Piano tones having pitches corresponding to manual depressions of keys on the keyboard are generated.

(2) Manual Speech Mode

Speech voices such as "Do", "Re" and "Mi" having pitches corresponding to manual depressions of the corresponding keys on the keyboard are generated.

(3) Auto Piano Mode

Piano tones are automatically generated by reading out the performance data from a performance data memory. In this case, the pitches of the piano tones are determined in accordance with pitch data included in the performance data. The speech voices can be generated in the auto piano mode in the same manner as in the manual speech mode. Speech performance can be accompanied by auto piano performance.

(4) Auto Speech Mode

Performance data is read out from the performance data memory and at the same time human voice data corresponding to the speech is read out from the human voice data memory, thereby automatically generating the speech voice. In addition, in the auto speech mode, the piano tones can be generated in the same manner as in the manual piano mode, thereby achieving manual piano performance together with auto speech performance.

Referring to FIG. 1, reference numeral 10 denotes a mode selector which includes a mode selection switch 12 and two OR gates 14 and 16. The mode selection switch 12 is set in any one of a manual piano mode (MP) position, a manual speech mode (MD) position, an auto piano mode (AP) position and an auto speech mode (AD) position. When the mode selection switch 12 is set in the MD or AP position, the OR gate 14 generates an output signal SL="1". However, when the mode selection switch 12 is set in the AP or AD position, the OR gate 16 generates an output signal AUT="1".

A timing signal generator 18 generates various timing signals for controlling the generation of piano tones and speech voices, and a detailed description thereof will be made later with reference to FIG. 2.

A keyboard circuit 20 includes a keyboard with 25 keys corresponding to $F_3$ (174.6 Hz) to $F_5$ (698.5 Hz) where numerals 3 and 5 represent octave numbers, respectively. The keyboard circuit 20 repeatedly scans the depressed keys and generates pitch data KPC corresponding to the depressed keys. The keyboard circuit 20 has a single key selection circuit. When a plurality of keys are more or less simultaneously depressed, pitch data KPC corresponding to the actual last key depressed is selected by the single key selection circuit. Each pitch data KPC comprises 5-bit data representing the pitch of the corresponding key. The MSB of the pitch data represents an octave code, and the remaining bits represent a note code. It should be noted that pitch data continues to be generated for each key while the corresponding key is being depressed.

A performance data generator 22 includes a performance data memory for storing performance data of, for example, 20 times. When the electronic musical instrument is powered and a player depresses a given key, a corresponding tune is read out from performance data memory. For example, when the pitch data KPC from the keyboard circuit 20 represents a pitch corresponding to the $F_5$ key (right most key), performance data from the first tune to the 20th tune are sequentially read out from the performance data memory. When the pitch data KPC represents a pitch corresponding to a specific key excluding the $F_5$ key, specific tune data is read out from the performance data memory depending on the name of the depressed key. In other words, when the player depresses the $F_5$ key, all tunes are designated. However, when the player depresses any key excluding the $F_5$ key, a specific tune is selected. In this case, the keys correspond to the tunes in advance.

PERFORMANCE DATA READ OPERATION

Data read operation for the performance data memory will be briefly described. When a tune to be read out is specified, tempo data of the specified tune (when all-tune performance is designated, the tempo data of the first tune) is read out from the performance data memory. Subsequently, pitch and duration data of the first note of the specified tune are read out.

A time division processor 24 performs three types of time division operations with respect to performance data readout. The first operation (A1) is to count reference clock signals for setting a tempo and to generate reference clock count data; the second operation (A2) is to count tempo clock signals and generate tempo clock count data; and the third operation (A3) is to count note duration end timing signals and generate read address data.

The performance data generator 22 generates a tempo clock signal having a frequency corresponding to a tempo of the specified tune in accordance with the reference clock count data generated as a data output DOA from the time division processor 24 and the tempo data read out from the performance data memory. The tempo clock signal is supplied as an output signal PO to the time division processor 24 which then counts the output signals PO. More specifically, the performance data generator 22 detects the note duration end timing of the first note in accordance with the tempo clock count data generated as the data output DOA from the time division processor 24 and the note duration data of the first note which is read out from the performance data memory and generates a note duration end timing signal. The note duration end timing signal is supplied as an output signal PO to the time division processor 24. In response to this signal, the time division processor 24 advances the read address by one. The updated read address data is supplied as a data output DOA to the performance data generator 22. In response to the address data, the performance data memory reads out pitch and duration data of the second note. In the same manner as described above, the pitch and duration data of the subsequent notes are sequentially read out. In case of a rest, pitch data of all "0" bits and duration data corresponding to the rest duration are read out.

The pitch data MPC for the respective notes of the specified tune can be read out from the performance data generator 22 in accordance with the above-mentioned performance data read operation. Each pitch data MPC comprises four bits which represent the pitch of a note. The MSB of the pitch data MPC represents an octave code, and the remaining bits represent a note code. The pitch data MPC is continuously generated for the corresponding note duration.

When the player does not depress any key upon energization of the electronic musical instrument, the performance data generator 22 prohibits data readout from the performance data memory. When the musical instrument is powered, key depression must be performed for all tunes or the specific tune in the AP or AD mode. No key need be depressed in the MP or MD mode.

Address data ADD for subroutine processing is supplied from the performance data generator 22 to the time division processor 24. At the time, a read end signal SRE for human voice data readout to be described later is supplied from the time division processor 24 to the performance data generator 22.

PIANO TONE GENERATION SECTION

A selector 26 selectively receives as inputs A and B the pitch data MPC generated from the performance data generator 22 and the pitch data KPC generated from the keyboard circuit 20. When the selection signal SA as an output signal SL from the OR gate 14 is set at logic "1", the selector 26 selects the input A. However, when the selection signal SA is set at logic "0", the selector 26 selects the input B. It should be noted that the output signal SL (i.e., the selection signal SA) from the OR gate 14 is set at logic "1" in the MD and AP modes. However, as described above, since the pitch data MPC is not generated in the MD mode, the selector 26 selects the pitch data MPC in only the AP mode. The output signal (i.e., the selection signal SA) from the OR gate 14 is set at logic "0" in the MP and AD modes. When the pitch data KPC is generated upon key depression, the selector 26 selects and generates the pitch data KPC.

The pitch data KPC or MPC selected by the selector 26 is used for producing a piano tone. The piano tone can be produced in the AP, MP and AD modes in accordance with the operating modes of the selector 26.

Note code data NT in the pitch data KPC or MPC generated from the selector 26 is supplied to a decoder 28. The decoder 28 has 13 output lines corresponding to 12 notes (i.e., F, F#, . . . E) and $F_5$ and decodes the note code data NT to detect a note name. A signal of logic "1" appears at the output line corresponding to the detected note name.

The 13 output lines of the decoder 28 are connected to the input of a frequency division control data memory 30 comprising a ROM (read-only-memory). The memory 30 generates 8-bit frequency division control data DVC in response to the output from the decoder 28. The frequency division control data DVC is exemplified as follows when the rightmost bit is the MSB:

"01110110" for F
"01101000" for F#
"10111011" for $F_5$

An octave code signal (the MSB signal) in the pitch data KPC or MPC generated from the selector 26 is supplied to a time division output circuit 32 to control the variable frequency division operation when a tone source signal is produced. An OR gate 34 receiving the respective bits of the pitch data KPC or MPC generated from the selector 26 generates a tone production enabling signal PKO which is set at logic "1" during the "1" duration of each of the bits constituting the pitch data. The signal PKO is supplied to the time division processor 24 to determine a rise timing of a piano envelope signal.

The time division output circuit 32 selectively supplies a high-speed clock signal $\phi$H and a low-speed clock signal $\phi$L in accordance with a frequency switching signal FC generated from the time division processor 24. The high-speed clock signal $\phi$H is used to obtain a relatively steep decay curve, while the low-speed clock signal $\phi$L is used to obtain a relatively moderate decay curve.

The time division processor 24 time-divisionally performs piano tone generation operations. The first operation (B1) is to count the pulses in response to the frequency division control data DVC and generate a frequency division output; and the second operation (B2) is to count the high- or low-speed clock signal $\phi$H or $\phi$L and generate envelope data representing the piano envelope.

The time division output circuit 32 generates a rectangular tone source signal TG having a frequency corresponding to the pitch of the pitch data in accordance with the frequency division output as the output DOB from the time division processor 24 and the octave code signal OCT from the selector 26. The time division output circuit 32 also generates 6-bit envelope data EV by performing inversion processing of the 8-bit envelope data as the data output DOB and bit shift processing on the basis of the amplitude level. The tone source signal TG and the envelope data EV are supplied to a digital/analog (D/A) converter 36.

The D/A converter 36 adds a piano envelope to the tone source signal TG in accordance with the envelope data EV. The tone source signal with this envelope is supplied to a loudspeaker 40 through an output amplifier 38. A piano tone is thus produced at the loudspeaker 40.

SPEECH VOICE GENERATING SECTION

A selector 42 selectively receives as inputs A and B the pitch data MPC generated from the performance data generator 22 and the pitch data KPC generated from the keyboard circuit 20. The selector 42 performs a selection operation opposite to that of the selector 26 in response to a selection signal SA obtained by inverting the output signal SL from the OR gate 14 through an inverter 44. The selection signal SA is set at logic "1" in the MP and AD modes. As described above, in the MP mode, the pitch data MPC is not generated, and the selector 42 selects the pitch data MPC in only the AD mode. The selection signal SA is set at logic "0" in the MD or AP mode. When the pitch data KPC is generated upon key depression, the selector 42 generates the pitch data KPC.

The pitch data KPC or MPC generated from the selector 42 is used for speech voice production. Speech voice can be produced in the AD, MD and AP modes in accordance with the operating modes of the selector 42.

The pitch KPC or MPC generated from the selector 42 is supplied to a human voice data generator 46 and can be used to select human voice data representing the speech data reciting the pitch name. The human voice data generator 46 includes a human voice data memory for storing human voice data representing fifteen tone names (i.e., "fa", "so", . . . "do" and "re" . . . "do" . . . "fa") for two octaves. In this embodiment, since a digital speech synthesis system of a so-called adaptive delta modulation system is employed, the human voice data memory stores human voice data of serial code data obtained by time-serially coding with a bit (logic "0" or "1") the human voice signal. In this case, coding is performed such that the human voice signal is sampled at a predetermined period, predictive values for the respective sampled points are obtained, and bit data "1" or "0" is assigned in accordance with the sign (i.e., positive or negative) of the differences between the predictive values and the actual values. This coding scheme is known to those who are skilled in the art, and a detailed description thereof will be omitted.

The time division processor 24 time-divisionally performs speech voice generation operations. The first operation (C1) is to count the clock signals and generate human voice read address data; the second operation (C2) is to calculate a step width corresponding to a change in amplitude in accordance with the readout data from the human voice data memory and produce step width data; and the third operation (C3) is to calculate predictive amplitude values in accordance with the step width data and generate predictive data.

An OR gate 48 receiving the bits of the pitch data KPC or MPC generated from the selector 42 generates a tone production enabling signal DKO which is set at logic "1" for the period where any of the bits constituting the pitch data exhibits "1". The signal DKO serves to cancel resetting of an address counter of the time division processor 24 through the performance data generator 22. The address counter counts the clock signals after this resetting and generates address data. In response to this address data, human voice data of fifteen tone names are parallel read out from the human voice data memory. In this case, the data is read out in the bit serial form for each tone. The human voice data representing the tone name speech corresponding to the pitch represented by the current pitch data is selected from among the readout human voice data.

The human voice data generator 46 generates as an output signal SO a signal required for step width calculation and predictive value calculation in accordance with the selected human voice data. The output signal SO is supplied to the time division processor 24.

The time division processor 24 generates the step width data of the sampled points in a waveshape (e.g., "do" of a specific octave) of a specific tone name speech in accordance with the output signal SO generated from the human voice data generator 46. At the same time, the time division processor 24 generates predictive value data of the respective sampling points in accordance with the output signal SO and the step width data. Each predictive value data is generated as a data output DOB which comprises 9-bit two's complement code data. The MSB of this data constitutes a sign bit.

The time division output circuit 32 translates the two's complement code of each predictive value data as the data output DOB from the time division processor 24 into a sign magnitude code. The circuit 32 also performs bit shift processing of the sign magnitude code in accordance with the corresponding amplitude level. The time division output circuit 32 thus generates amplitude data AM and a sign bit signal SG for each sampling point. Each amplitude data AM represents a predictive value of the amplitude, and each sign bit signal comprises logic "1" or "0" which represents a sign (positive or negative) of the predictive value.

The D/A converter 36 converts to analog values the amplitude data AM and the sign bit signal SG which are supplied from the time division output circuit 32 thereto and reproduces the prediction signal. The analog prediction signal has a waveshape substantially corresponding to a change in predictive value obtained for coding. The analog prediction signal is supplied to the loudspeaker 40 through the output amplifier 38, thereby producing a tone name speech at the loudspeaker 40.

In the above description, the piano tone or speech tone is separately generated. However, in the AP or AD mode, and the piano tone generating processing and the speech tone generating processing are time-divisionally performed, and the piano tone and the speech voice are simultaneously produced at the loudspeaker 40.

TIMING SIGNAL GENERATOR

Figure 2:
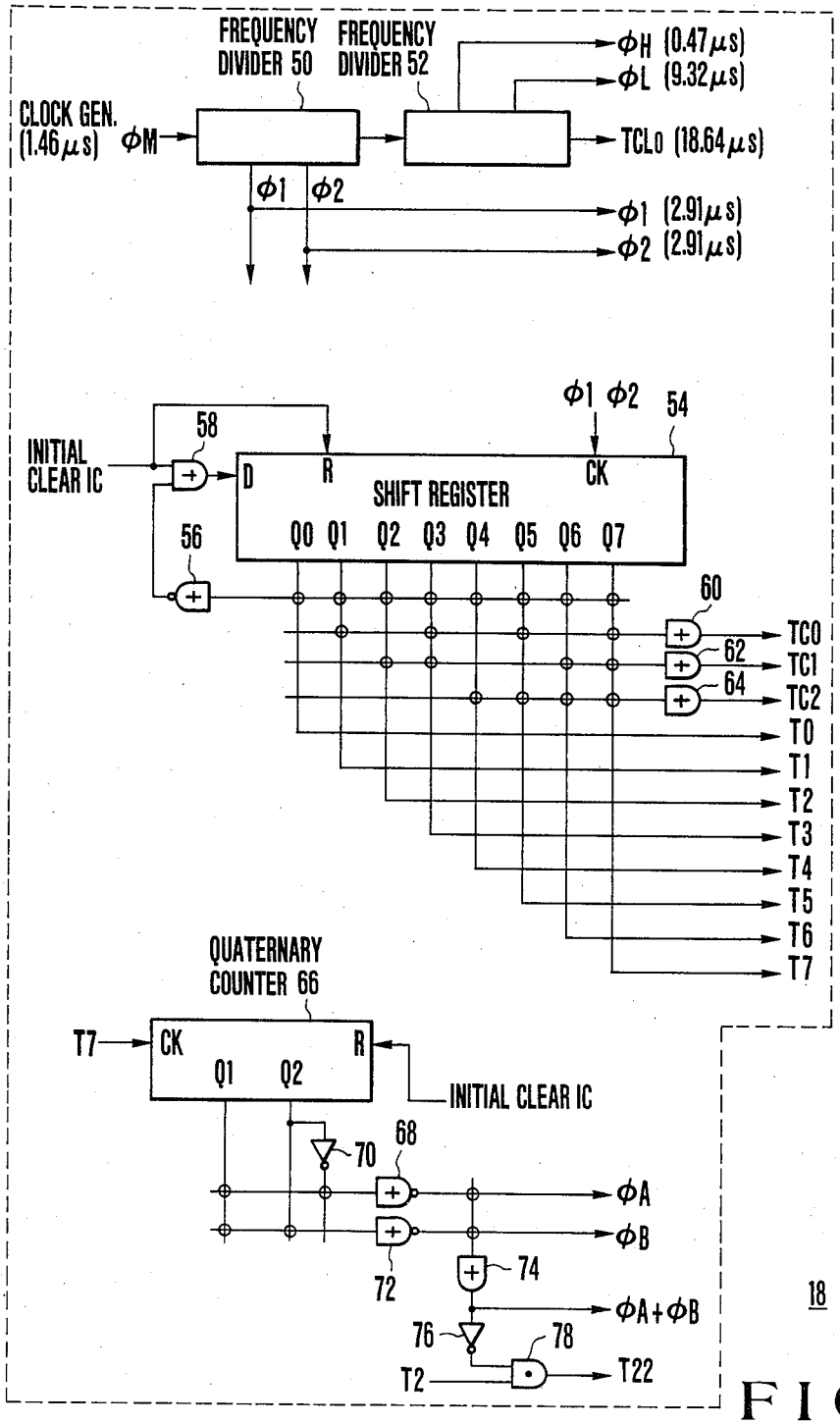
FIG. 2 is a circuit diagram of a timing signal generator in the electronic musical instrument shown in FIG. 1.

FIG. 2 shows a detailed arrangement of the timing signal generator 18.

Figure 3:
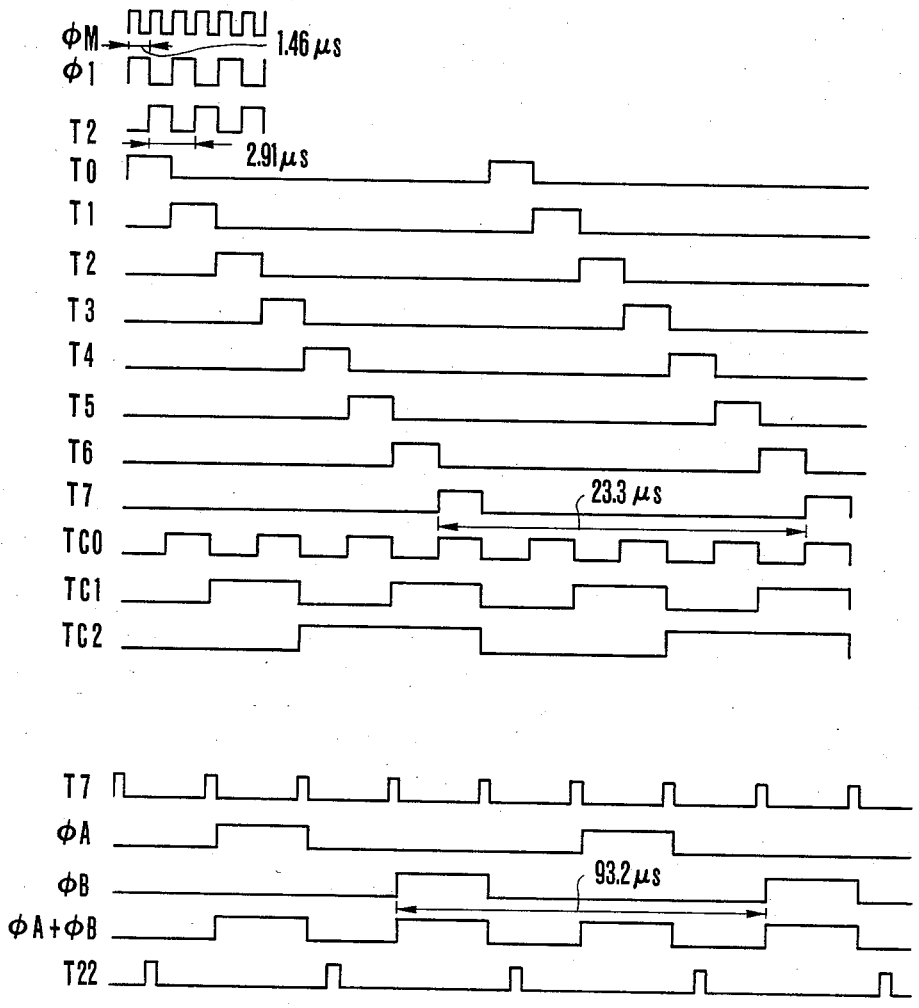
FIG. 3 is a timing chart of various timing signals for explaining the operation of the electronic musical instrument shown in FIG. 1.

A frequency divider 50 divides a master clock signal $\phi M$ having a 1.46-$\mu$s period and generates clock signals $\phi 1$ and $\phi 2$ having phases which are 180° apart from each other, as shown in FIG. 3. Each of the clock signals $\phi 1$ and $\phi 2$ has a 2.91$\mu$s period.

A frequency divider 52 divides output signals generated from the frequency divider 50 to generate the high- and low-speed clock signals $\phi H$ and $\phi L$. At the same time, the frequency divider 52 generates a reference clock signal TCL0 for setting the tempo. The high-speed clock signal $\phi H$ has a 0.47-ms period, and the low-speed clock signal $\phi L$ has a 9.32-ms period. The reference clock signal TCL0 has a 18.64-ms period.

A shift register 54 is reset in response to an initial clear signal IC generated in synchronism with system energization. The shift register 54 receives as a data input D an output signal of logic "1" from a NOR gate 56 through an OR gate 58. In this case, the output from the NOR gate 56 corresponds to outputs Q0 to Q7 in the reset mode of the shift register 54. The shift register 54 shifts the input D in response to the clock signals $\phi 1$ and $\phi 2$ and generates timing signals T0 to T7 as the outputs Q0 to Q7, as shown in FIG. 3. Each of the timing signals T0 to T7 has a 23.3-$\mu$s period and a pulse width corresponding to one period of the clock signal $\phi 1$. The timing signals T0 to T7 are used to control the time division processing for 8 channels in the time division processor 24.

An OR gate 60 receives the timing signals T1, T3, T5 and T7 and generates a timing signal TC0, as shown in FIG. 3. An OR gate 62 receives timing signals T2, T3, T6 and T7 and generates a timing signal TC1, as shown in FIG. 3. An OR gate 64 receives the timing signals T4 to T7 and generates a timing signal TC2, as shown in FIG. 3.

A quarternary counter 66 counts the timing signals T7 after it is reset in response to the initial clear signal IC. A NOR gate 68 receives the output Q1 from the counter 66 and an output from an inverter 70 for inverting the output Q2 generated from the counter 66. The NOR gate 68 generates a timing signal $\phi A$, as shown in FIG. 3. A NOR gate 72 receives the outputs Q1 and Q2 from the counter 66 and generates a timing signal $\phi B$, as shown in FIG. 3. Each of the timing signals $\phi A$ and $\phi B$ has a 93.2$\mu$s period.

An OR gate 74 receives the timing signals $\phi A$ and $\phi B$ and generates a timing signal $\phi A+\phi B$, as shown in FIG. 3. The timing signal $\phi A+\phi B$ is supplied to an AND gate 78 through an inverter 76 and is logically ANDed with the timing signal T2. The AND gate 78 generates a timing signal T22, as shown in FIG. 3.

DETAIL OF PERFORMANCE DATA READOUT

Figure 4:
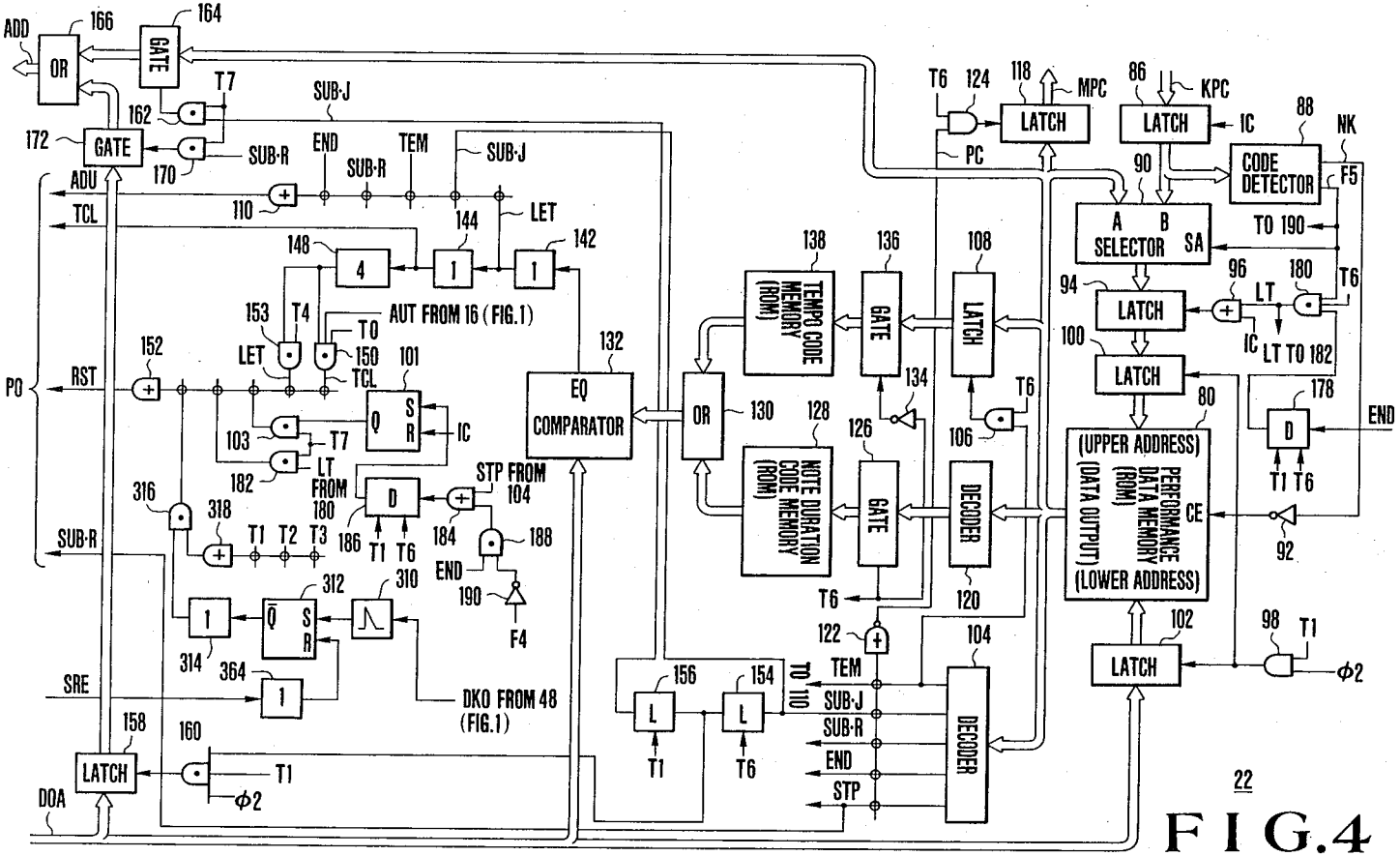
FIG. 4 is a circuit diagram of a performance data generator in the electronic musical instrument shown in FIG. 1.
Figure 5:
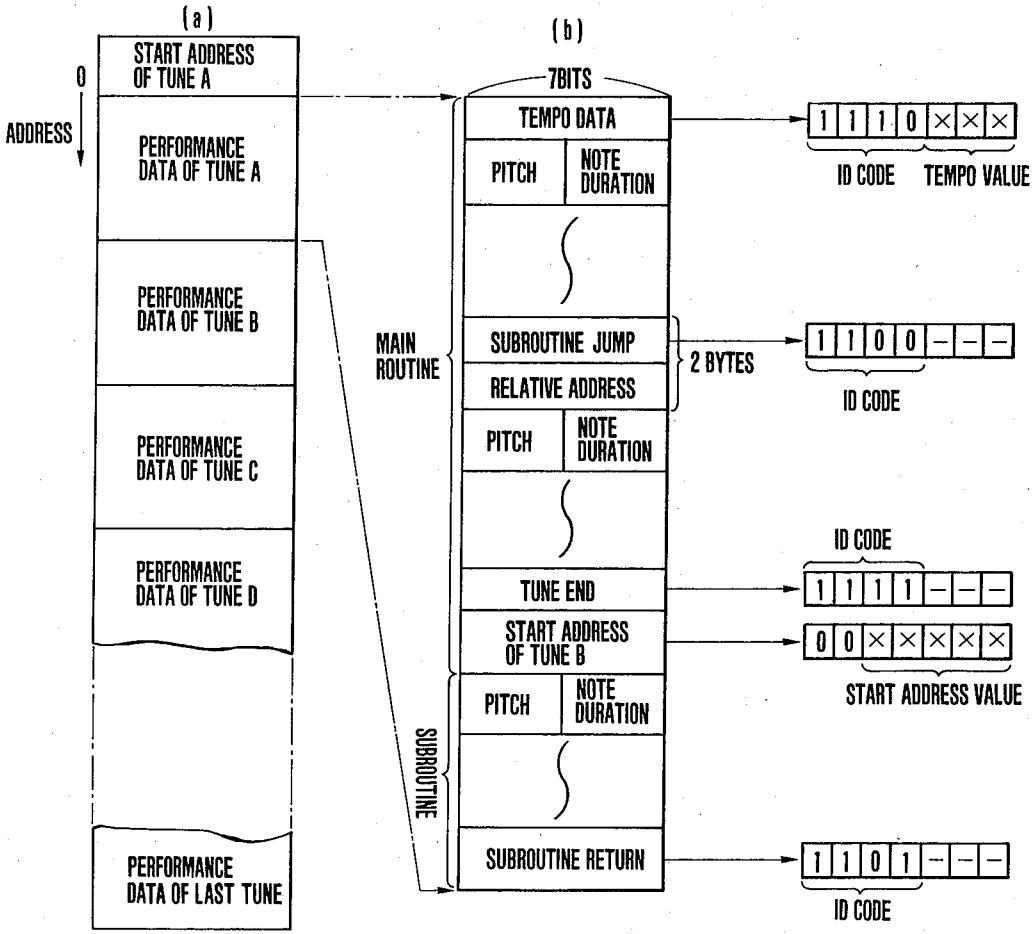
FIGS. 5A and 5B are respectively formats showing performance data used in the electronic musical instrument shown in FIG. 1.

The performance data generator 22 comprises a performance data memory 80 of a ROM (read-only memory), as shown in FIG. 4. The memory 80 stores performance data representing 20 tunes in a format shown in FIG. 5. More particularly, as shown in FIG. 5A, start address data representing a start address of tune A (i.e., the first tune) is stored at address 0. The performance data for tunes B, C, D, . . . are stored at the following addresses. Data of tune A comprises 7-bit main routine segment and 7-bit subroutine segment, as shown in FIG. 5B. The main routine segment comprises the tempo data, and the pitch/duration data of the respective notes. In addition, 2-byte data (i.e., subroutine jump data and relative address data) for subroutine is inserted between the pitch/duration data. The subroutine segment comprises the pitch/duration data of the respective notes. Subroutine return data is added to the end of the pitch/duration data.

In the main routine segment, the tune end data and the start address data of the next tune (in this case, tune B) are sequentially arranged next to the pitch/duration data of the last note of the current tune. Since no next tune is provided next to the last tune (i.e., the 20th tune), stop data is arranged at a location corresponding to the start address data of the unprovided next tune.

The tempo data is provided to set a tempo of a tune. The upper four bits of the tempo data represent an identification code (1110), and the remaining bits represent a tempo value.

The pitch/duration data represents the pitch and duration of each note. The upper four bits of the pitch-/duration data represent a pitch code, and the remaining three bits represent a note duration code. In the pitch code, the MSB represents an octave code, and the remaining three bits represent a note code. The pitch code having all "0" bits is used for a rest.

The subroutine jump data designates a jump to the subroutine segment. The upper four bits of the subroutine jump data represent an identification code (1100), and the remaining three bits are not used. The subroutine segment is provided to store predetermined performance data so as to decrease a memory capacity when the predetermined performance data is repeatedly read out since the memory capacity must be increased if the predetermined performance data were stored in a plurality of memory locations. In this case, when the predetermined performance data must be repeatedly read out, the original memory location is repeatedly accessed (by the subroutine return).

The relative address data enables the start address access of the subroutine segment. The relative address data represents an address value relatively determined in accordance with the address thereof. If the start address of the subroutine segment and the address for the relative address data are defined as AS and AR, the relative address data represents the address value represented by (AS—AR).

The tune end data serves to designate the end of a tune. The upper four bits of the end data represent the identification code (1111) and the remaining three bits are not used.

The start address data of the next tune represents an address at which the first data (i.e., tempo data) of the performance data of the next tune is stored. The upper two bits of the start address data are both "0", and the remaining five bits represent a start address value.

The subroutine return data represents a return from the subroutine segment to the main routine segment. The upper four bits of the subroutine return data are (1101), and the remaining three bits are not used.

As previously described, the time division processor 24 performs time division operations: (A1) reference clock count data generation processing; (A2) tempo clock count data generation processing; and (A3) read address data generation processing. The processing timings and the output timings in (A1) to (A3) are represented by the timing signals T0 to T7, as shown in Table 1.

TABLE 1

| Processing Content | Processing Timing | Output Timing |
|---|---|---|
| A1 | T0 | T2 |
| A2 | T4 | T6 |
| A3 | T7 | T1 |

According to Table 1, the output timing is delayed by two pulses (i.e., two periods of the clock signal $\phi 1$) of each of the timing signals T0 to T7 as compared with the processing timing.

Figure 6:
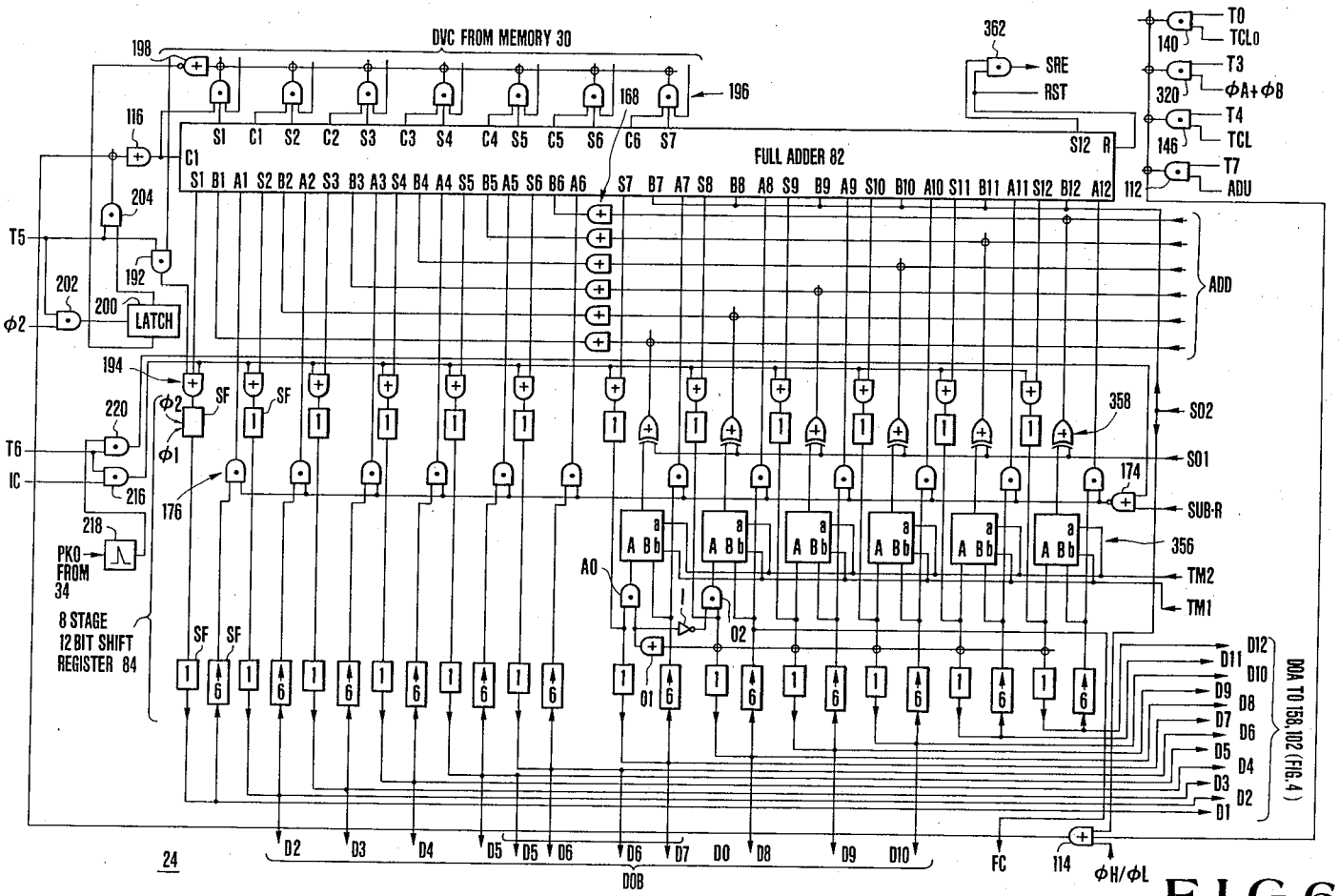
FIG. 6 is a circuit diagram of a time division processor in the electronic musical instrument shown in FIG. 1.

As shown in FIG. 6, the time division processor 24 comprises a 12-bit full adder 82 and an 8-stage/12-bit shift register circuit 84 which receives as inputs A1 to A12 outputs S1 to S12 generated from the full adder 82. The shift register circuit 84 comprises eight 1-stage/1-bit two-phase shift registers SF and receives the corresponding bit in response to the clock signal $\phi 2$ and generates it in response to the clock signal $\phi 1$. Numeral "1" written in the block of each shift register SF represents that an output signal such as the signal T1 is delayed by one pulse (i.e., one period of the clock signal $\phi 1$) when the timing signal T0 of FIG. 3 is received thereat. The above operation applies to any other block of FIG. 6 or FIG. 4 which is designated by a numeral therein. For example, the block having numeral "6" represents a 6-stage/1-bit shift register for performing 6-pulse delay.

The output signal from the time division processor 24 comprises 2-stage outputs D1 to D12 from the shift register circuit 84. This indicates that the output timing is delayed by two pulses from the processing timing, as described with reference to Table 1.

In the performance data read operation, the full adder 82 and the lower 6-bit arrangement of the shift register circuit 84 are used as an 8-stage/6-bit time division counter.

Assume that the electronic musical instrument is powered and that the player depresses the $F_5$ key. In the circuit shown in FIG. 4, in response to the initial clear signal IC, a latch circuit 86 latches the pitch data KPC generated from the keyboard circuit 20. The pitch data KPC represents a pitch represented by the $F_5$ key. A code detector 88 generates the $F_5$ key detection signal F5="1", and a selector 90 selects the input A. In this case, a no-key-depression signal NK from the code detector 88 is set at logic "0" since the key is depressed. This signal of logic "0" is inverted as a chip enable signal CE="1" by an inverter 92, and the signal CE="1" is supplied to the performance data memory 80. For this reason, the data (i.e., the start address data of tune A) at address 0 is read out from the memory 80. The readout data is supplied to a latch circuit 94 through the selector 90 and latched in response to the initial clear signal IC generated from an OR gate 96.

An AND gate 98 generates an output signal of logic "1" in response to the timing signal T1 and the clock signal $\phi 2$, so that the pitch data corresponding to the $F_5$ key and supplied from the latch circuit 94 is latched by a latch circuit 100. At the same time, the address data D1 to D6 from the time division counter of FIG. 6 are latched by a latch circuit 102. The address data D1 to D6 are all "0" bits. This is because the resetting state of the full adder 82 of FIG. 6 is cancelled by the output signal "0" from the AND gate 103 of FIG. 4 in response to the timing signal T7, and the channel of the timing signal T7 of the time division counter is zero when an R-S flip-flop 101 is reset in response to the initial clear signal IC in FIG. 4.

The data latched by the latch circuits 100 and 102 are respectively supplied as the upper and lower address data to the memory 80. The tempo data of tune A is read out from the memory 80.

The tempo data is supplied to a decoder 104, and the decoder 104 generates a tempo data detection signal TEM="1". The detection signal TEM is supplied to an AND gate 106 which then generates an output signal of logic "1" in response to the timing signal T6. A latch circuit 108 latches the tempo data from the memory 80 in response to the "1" output signal from the AND gate 106.

The tempo data detection signal TEM is supplied as an address advance signal ADU to an AND gate 112 of FIG. 6 through an OR gate 110. The AND gate 112 generates an output signal of logic "1" in response to the timing signal T7. This "1" output signal is supplied as a carry input Ci to the full adder 82 through OR gates 114 and 116. Therefore, the channel of the signal T7 of the time division counter is set to be count "1". The address data D1 to D6 which represent the count "1" are supplied from the shift register circuit 84 in response to the timing signal T1 and latched by the latch circuit 102 at timings of the signals T1 and $\phi 2$. The pitch/duration data of the first note of tune A can be read out from the memory 80.

The pitch data in the readout data is supplied to the decoder 104 and a latch circuit 118, and the note duration data therein is supplied to a decoder 120. When the decoder 104 receives the pitch data, all output pulses therefrom are set at "0" level, and a NOR gate 122 generates a pitch data detection signal PC="1". The detection signal PC is supplied to an AND gate 124 which then generates an output signal of logic "1" in response to the timing signal T6. The latch circuit 118 latches the pitch data read out from the memory 80. Therefore, the latch circuit 118 generates as pitch data MPC the pitch data of the first note.

A gate circuit 126 is enabled at the same timing as the output timing of the pitch data MPC. The output from the decoder 120 for decoding the note duration data of the first note is supplied to a note duration code memory 128 of a ROM through the gate circuit 126. The memory 128 encodes the output from the decoder 120 in accordance with the type (e.g., quarter note duration) of note duration so as to compare the decoded result with the count of the time division counter of FIG. 6. The note duration code data from the memory 128 is supplied to a comparator 132 through an OR gate 130.

The tempo data latched by the latch circuit 108 is supplied to a tempo code memory 138 comprising a ROM through a gate circuit 136 enabled at a timing excluding the duration of the timing signal T6 but in response to an output signal from an inverter 134. The memory 138 translates the lower 3-bit tempo value data of the tempo data so as to compare the decoded data with the output from the time division counter of FIG. 6. The tempo code data from the memory 138 is supplied to the comparator 132 through the OR gate 130.

Referring to FIG. 6, an AND gate 140 generates a tempo setting reference clock signal TCL0 in response to the timing signal T0. The reference clock signal TCL0 is supplied as the carry input Ci to the full adder 82 through the OR gates 114 and 116. For this reason, the channel of the timing signal T0 for the time division counter is arranged such that a count of the counter is incremented by one every time the signal TCL0 is counted. The reference clock count data D1 to D6 based on the above counting operation are supplied to the comparator 132 (FIG. 4) for every timing signal and are compared with the tempo code data from the memory 138.

When the comparator 132 detects a coincidence between the reference clock count data and the tempo code data, the comparator 132 generates a coincidence signal EQ. The coincidence signal EQ is supplied as a tempo clock signal TCL to an AND gate 146 of FIG. 6 through shift registers 142 and 144. The AND gate 146 generates a tempo clock signal TCL in response to the timing signal T4.

Referring to FIG. 4, the tempo clock signal TCL from the shift register 144 is supplied to an AND gate 150 through a shift register 148. In this case, the AND gate 150 also receives an output signal "1" representing the AP or AD mode and supplied from the OR gate 16 of FIG. 1. The AND gate 150 generates the tempo clock signal TCL in response to the timing signal T0. The tempo clock signal TCL is supplied as a reset signal RST to the full adder 82 of FIG. 6 through an OR gate 152, so that the full adder 82 is reset. As a result, all the bits of the output from the time division counter are set at logic "0". Thereafter, the time division counter starts counting the reference clock signals TCL0 in the same manner as described above.

When comparison and counting are performed as described above, the tempo clock signal TCL having a frequency corresponding to the tempo value of the tempo data of tune A is generated from the AND gate 146 shown in FIG. 6. Since the tempo clock signal TCL is supplied to the full adder 82 through the OR gates 114 and 116, the channel of the timing signal T4 for the time division counter is changed such that the count of the counter is incremented by one every time the tempo clock signal TCL is counted.

The tempo clock count data D1 to D6 based upon the counting operation as described above are supplied to the comparator 132 of FIG. 4 and are compared with the note duration code of the first note which is read out from the memory 128. When a coincidence between the tempo clock count data and the note duration code data is established, the comparator 132 generates the coincidence signal EQ. The coincidence signal EQ is supplied as a note duration end timing signal LET to the OR GATE 110 through the shift register 142. The OR gate 110 then supplies it as an address advance signal ADU to the AND gate 112 shown in FIG. 6.

In this case, the note duration end timing signal LET represents a note duration end timing of the first note and is supplied from the AND gate 112 to the full adder 82 through the OR gates 114 and 116. For this reason, the count of the time division counter for the channel of the timing signal T7 is incremented by one. The address data D1 to D6 are generated from the shift register circuit 84 in response to the timing signal T1 and are latched by the latch circuit 102 of FIG. 4 in response to the signals T1 and $\phi 2$. Therefore, the pitch/duration data of the second note of tune A is read out from the memory 80.

The note duration end timing signal LET from the shift register 142 is supplied to an AND gate 153 through shift registers 144 and 148, and the AND gate 153 generates an output signal of logic "1" in response to the timing signal T4. This output signal is supplied as the reset signal RST to the full adder 82 of FIG. 6 through the OR gate 152, thereby resetting the full adder 82. For this reason, the channel for the timing signal T4 in the time division counter comprises all "0" bits. The time division counter starts counting the tempo clock signals TCL for the duration data of the second note in the same manner as described above.

The note duration comparison/address advance operation as described above is repeated to sequentially generate the pitch data MPC from the latch circuit 118.

When the pitch/duration data read operation is continued as described above, the subroutine jump data is read out from the memory 80 in response to the signals T1 and $\phi 2$. The decoder 104 generates a subroutine jump detection signal SUB·J="1". The detection signal SUB·J is latched in response to the timing signal T6 and is also supplied to the AND gate 112 of FIG. 6 through the OR gate 110. The signal SUB·J is supplied from the AND gate 112 to the full adder 82 through the OR gates 114 and 116 in response to the timing signal T7. For this reason, the channel of the timing signal T7 in the time division counter is changed such that a count of the counter is incremented by one. The updated address data D1 to D6 are generated from the shift register 84 in response to the timing signal T1. The address data D1 to D6 represents a storage location AR for the relative address data.

While the signal SUB·J from a latch circuit 154 is latched by a latch circuit 156, a latch circuit 158 receives the address data representing address AR in accordance with the output signal generated from an AND gate 160 at times of T1 and $\phi 2$ in response to the latch signal SUB·J. At the same time, the latch circuit 102 latches the address data representing the address AR in response to the signals T1 and $\phi 2$. In synchronism with this operation, the relative address data is read out from the memory 80. If the start address of the subroutine segment is defined as AS, the relative address data represents address (AS-AR).

In response to the timing signal T7, an AND gate 162 generates an output signal of logic "1" in accordance with the signal SUB·J latched by the latch circuit 156, thereby enabling a gate circuit 164. For this reason, the relative address data read out from the memory 80 is supplied as inputs B1 to B6 to the full adder 82 through the gate circuit 164, an OR gate 166 and OR gates 168 of FIG. 6. In this case, the inputs A1 to A6 to the full adder 82 comprise the address data representing the address AR, so that outputs S1 to S6 from the full adder 82 comprise the address data representing the start address AS of the subroutine segment. This address data is generated from the shift register 84 in response to the timing signal T1 and is latched by the latch circuit 102 of FIG. 4 in response to the signals T1 and $\phi 2$. As a result, the pitch/duration data of the subroutine segment are sequentially read out from the memory 80 in the same manner as in the main routine segment.

Thereafter, when the note duration end timing of the last note of the subroutine segment is obtained, the subroutine return data is read out from the memory 80 in response to the signals T1 and $\phi 2$. In synchronism with this read operation, the decoder 104 generates a subroutine return detection signal SUB·R="1". The detection signal SUB·R is supplied to an AND gate 170, and the AND gate 170 generates an output signal of logic "1" in response to the timing signal T7, thereby enabling a gate circuit 172. The address data representing the address AR and latched by the latch circuit 158 is supplied as inputs B1 to B6 to the full adder 82 through the gate circuit 172 and the OR gate 166 and further through the OR gates 168 of FIG. 6. In this case, the detection signal SUB·R disables the output signal from a NOR gate 174 and then each of AND gates 176. All the inputs A1 to A12 to the full adder 82 are thus set at logic "0".

The detection signal SUB·R is supplied to the AND gate 112 of FIG. 6 through the OR gate 110 of FIG. 4, and the AND gate 112 generates the output signal of logic "1" which is the same as the timing signal T7 from the AND gate 170. This output signal of logic "1" is supplied as the carry input Ci to the full adder 82 through OR gates 114 and 116. Outputs S1 to S6 from the full adder 82 comprise address data representing address (AR+1) (i.e., the address next to the address for the relative address data). The updated address data is generated from the shift register circuit 84 in response to the timing signal T1 and is latched by the latch circuit 102 of FIG. 4 in response to the signals T1 and $\phi 2$. As a result, the pitch/duration data next to the relative address data of the main routine segment is read out from the memory 80. The same pitch/duration data read operation as performed prior to the subroutine jump is performed.

Thereafter, when the note duration end timing of the last note of the main routine segment is obtained, tune end data is read out from the memory 80. In synchronism with the tune end data, the decoder 104 generates a tune end detection signal END="1". The detection signal END is supplied to the AND gate 112 of FIG. 6 through the OR gate 110. The channel for the timing signal T7 in the time division counter is changed such that a count thereof is incremented by one. In accordance with the updated address data, the start address data of the next tune B is read out from the memory 80 in response to the signals T1 and $\phi 2$.

The detection signal END is also supplied to a delay (D) circuit 178. The delay circuit 178 comprises a 2-phase shift register which receives an input in response to the timing signal T6 and which generates an output in response to the timing signal T1. This output signal is supplied to an AND gate 180 and is logically ANDed with the F4 key detection signal F4 and the timing signal T6. When the next timing signal T6 is supplied, the AND gate 180 generates an output signal LT="1". This output signal LT is supplied to the latch circuit 94 through the OR gate 96. The latch circuit 94 latches the start address data of the next tune B which is supplied from the memory 80 through the selector 90.

The output signal LT is also supplied to an AND gate 182 which generates an output signal of logic "1" in response to the timing signal T7. This output signal serves to reset the full adder 82 of FIG. 6 through the OR gate 152, so that the channel for the timing signal T7 in the time division counter is reset to zero.

The address data corresponding to the zero count is generated from the shift register circuit 84 in response to the timing signal T1 and is latched by the latch circuit 102 in response to the output signal of logic "1" from the AND gate 98 of FIG. 4. In this case, the output signal of logic "1" from the AND gate 98 is supplied to the latch circuit 100. The latch circuit 100 then latches the start address data of tune B which is supplied from the latch circuit 94. For this reason, the tempo data of the tune B is read out from the memory 80. The performance data read operation of the tune B is performed in the same manner as for tune A.

The performance data read operations for tunes C, D, . . . are sequentially performed, and the stop data at the end of the last tune is read out from the memory 80. Under this condition, the decoder 104 generates a stop detection signal STP="1". The detection signal STP is supplied through an OR gate 184 to a delay circuit 186 having the same arrangement as the delay circuit 178. For this reason, the flip-flop 101 is set in response to the timing signal T1 next to the timing signal T6. The AND gate 103 generates an output signal of logic "1" in response to an output Q="1" from the flip-flop 101. This output signal of logic "1" serves to reset the full adder 82 of FIG. 6 through the OR gate 152. The channel for the timing signal T7 in the time division counter is changed such that a count thereof is reset to zero. The zero count state of the time division counter is kept thereafter. Therefore, the data read operation of the memory 80 is stopped.

The above performance data read operation is made when all the tunes are specified. Performance data operation for single tune selection will be described as follows.

In this case, the player depresses a desired key excluding the $F_5$ key. In the circuit of FIG. 4, pitch data KPC corresponding to the depressed key is latched by the latch circuit 86 in response to the initial clear key IC. The pitch data KPC represents a pitch corresponding to the depressed key excluding the $F_5$ key. The $F_5$ key detection signal F5 from the code detector 88 is set at logic "0". The selector 90 is held in a state to select the input B. For this reason, the pitch data KPC from the latch circuit 86 is supplied to the latch circuit 94 through the selector 90 and latched thereby in response to the initial clear signal IC generated from the OR gate 96. Furthermore, since the no-key-depression signal NK from the code detector 88 is set at logic "0", the chip enable signal CE from the memory 80 is set at logic "1".

In response to the output signal of logic "1" from the AND gate 98 at timings of the signals T1 and 2, the pitch data corresponding to the selected tune is supplied from the latch circuit 94 to the latch circuit 100 and the all "0" address data from the time division counter of FIG. 6 is supplied to the latch circuit 102. For this reason, the tempo data in the performance data of the selected tune is read out from the memory 80. Thereafter, the pitch/duration data or the like of each note is read out in the same manner as in the case of the tune A.

When such read operation is continued, the tune end data is read out from the memory 80, and the decoder 104 generates the tune end detection signal END="1". The start address data of the next tune is read out from the memory 80 upon generation of the detection signal END. Since the selector 90 is in the state to select the input B, the start address data will not be supplied to the latch circuit 94. Since the $F_5$ key detection signal F5="0" disables the AND gate 180, the latch circuit 94 is rendered inactive.

The detection signal END is supplied to an AND gate 188 and logically ANDed with an output from an inverter 190 for receiving the $F_5$ key detection signal F5. Since the $F_5$ key detection signal F5 of logic "0" is inverted to a signal of logic "1", the AND gate 188 generates an output signal of logic "1". The signal of logic "1" is supplied to the delay circuit 186 through the OR gate 184. For this reason, in the same manner as in stop data read operation, the channel for the timing signal T7 in the time division counter of FIG. 6 is set in the reset state, thereby inhibiting data read operation of the memory 80.

When the player does not depress any key upon energization of the electronic musical instrument, the no-key-depression signal NK from the code detector 88 is set at logic "1", and then the chip enable signal CE is set at logic "0", thereby inhibiting the data read operation of the memory 80.

DETAIL OF PIANO TONE GENERATING OPERATION

As previously described, the time division processor 24 performs the following piano tone generation operations: (B1) the frequency division output generation processing; and (B2) the envelope data generation processing. The relationship between the timing signals T0 to T7 and the processing and output timings is summarized in Table 2 as follows:

TABLE 2

| Processing Content | Processing Timing | Output Timing |
|---|---|---|
| B1 | T5 | T7 |
| B2 | T6 | T0 |

According to Table 2, the delay of the output timing with respect to the processing timing is the same as that in Table 1.

Referring to FIG. 6, at timing of T5, the circuit portion corresponding to seven bits from the LSB in the full adder 82 and the shift register 84 is used as a 7-bit counter. The 7-bit counter generates the frequency division output D0. At timing of T6, the circuit portion corresponding to nine bits from the LSB in the full adder 82 and the shift register 84 is used as a 9-bit counter. The 9-bit counter generates the 8-bit (D2 to D9) envelope data.

During the frequency division output generation operation, an AND gate 192 receives the LSB signal of the frequency division control data DVC from the frequency division control data memory 30 of FIG. 1. The LSB signal is supplied to the shift register SF through an OR gate of OR gates 194 which corresponds to the LSB in response to the timing signal T5. Among AND gates 196, the AND gates which respectively receive the outputs S1, S2, . . . and S7 from the full adder 82 receive the carry input Ci and the carry outputs C1, C2, . . . C6, respectively. These AND gates also receive bit signals comprising the second to seventh bits of the frequency division control data DVC. The output signals from the AND gates 196 are supplied to a NOR gate 198.

A latch circuit 200 latches the output signal from the NOR gate 198 in response to the output signal of logic "1" from an AND gate 202 and at the timing determined by the signals T5 and $\phi 2$. When the output signal from the NOR gate 198 is set at logic "1", the latched signal of logic "1" is generated therefrom. This signal of logic "1" is supplied as the carry input Ci to the full adder 82 through an AND gate 204 in response to the timing signal T5 and through the OR gate 116. For this reason, the output signal "1" or "0" from the NOR gate 198 determine as to whether or not the pulses are supplied to the full adder 82.

With the above arrangement, the counting operation of the channel for the timing signal T5 in the 7-bit counter is controlled in accordance with the frequency division control data DVC, so that the frequency division signals D5, D6 and D7 corresponding to the desired note (e.g., F) are generated from the 5th to 7th bit outputs of the 7-bit counter, respectively. In the frequency division signals D5 to D7, the frequency of the signal D6 is ½ of the frequency of the signal D5, and the frequency of the signal D7 is ½ of the frequency of the signal D6. The signals D5 to D7 are supplied as the frequency division output D0 to the time division output circuit 32 of FIG. 7. When the frequency division output D0 is regarded as the count data at the timing of the timing signal T5, the count data is supplied from the shift register circuit 84 to the circuit of FIG. 7 in response to the timing signal T7.

Figure 7:
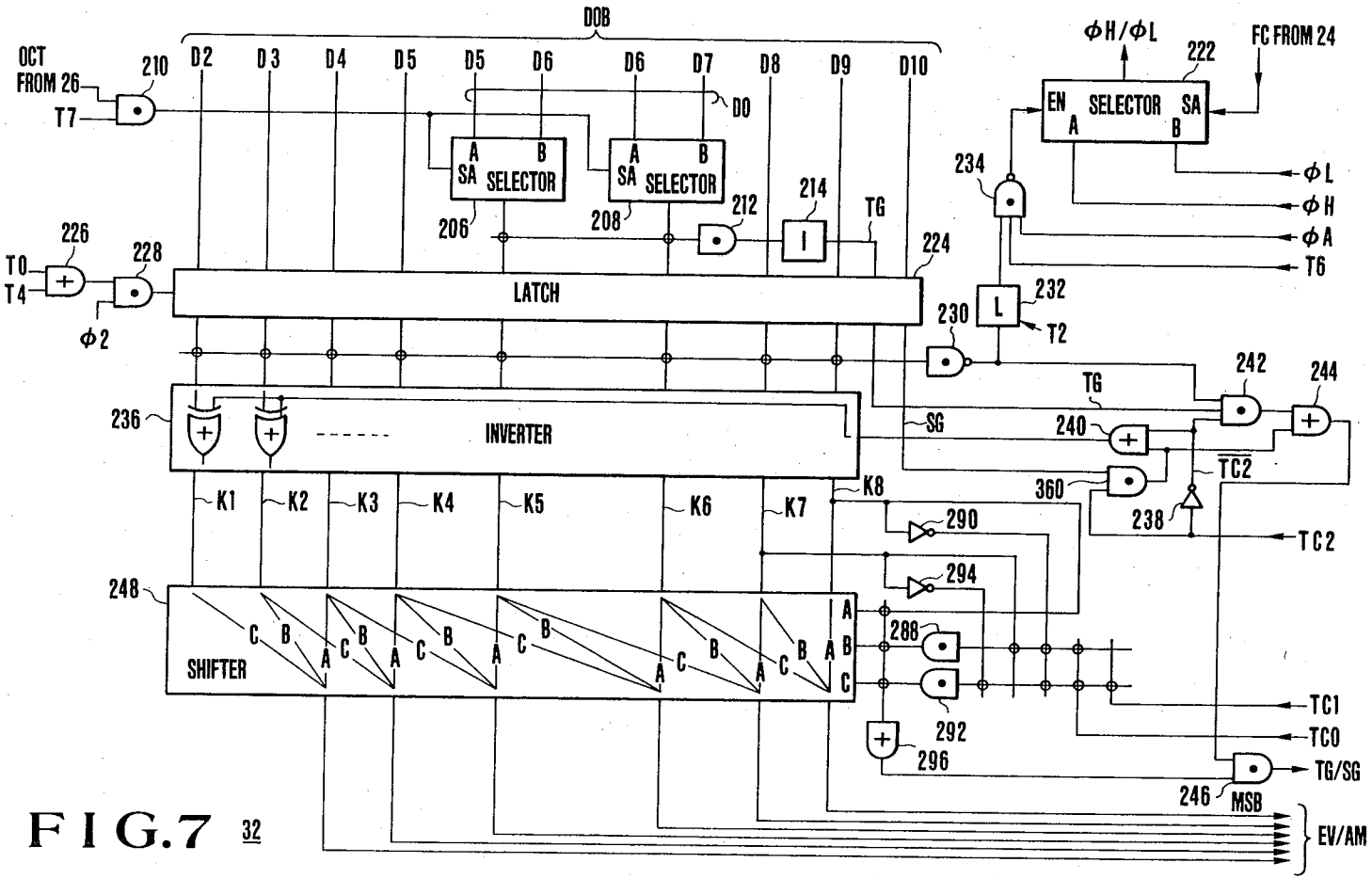
FIG. 7 is a circuit diagram of a time division output circuit in the electronic musical instrument shown in FIG. 1.

Referring to FIG. 7, the frequency division signals D5 and D6 are supplied as inputs A and B to a selector 206, respectively. The frequency division signals D6 and D7 are supplied as inputs A and B to a selector 208, respectively. The selection operation of the selectors 206 and 208 is controlled by the selection signal SA as an output signal from an AND gate 210 for receiving the octave code signal OCT and the timing signal T7.

When the octave code signal OCT is set at logic "0" (this means the octave of from $F_3$ to $E_4$ notes), the selection signal SA is set at logic "0" for every timing signal T7. The selector 206 selects the frequency division signal D6, and the selector 208 selects the frequency division signal D7. An AND gate 212 generates an output signal of logic "1" every time the outputs from the selectors 206 and 208 are set at logic "1". The output signal of logic "1" is generated through a shift register 214 having the same arrangement as the shift register SF of FIG. 6, in response to the timing signal T0. In this case, when the frequency division signals D5 to D7 are generated for the note F, for example, the shift register 214 generates a rectangular tone source signal TG having a frequency corresponding to the $F_3$ tone.

When the octave code signal OCT is set at logic "1" (this means the octave of from $F_4$ to $E_5$ notes and a note of $F_5$), the selection signal SA is set at logic "1" for every timing signal T7. The selector 206 generates the frequency division signal D5, and the selector 208 generates the frequency division signal D6. The AND gate 212 generates an output signal of logic "1" every time the outputs from the selectors 206 and 208 are set at logic "1". The output signal of logic "1" from the AND gate 212 is generated through the shift register 214 in response to the timing signal T0. In this case, when the frequency division signals D5 to D7 are generated for the note F, the shift register 214 generates the rectangular tone source signal TG having a frequency corresponding to the $F_4$ note. Since the frequency division control data DVC is determined such that the frequency of the frequency division signal D5 for the $F_5$ note is twice of that for the F note, the tone source signal TG having the frequency corresponding to the $F_5$ note can be obtained when the octave code signal OCT is set at logic "1".

During the envelope data generation processing, an AND gate 216 (FIG. 6) generates an output signal of logic "1" in response to the initial clear signal IC and the timing signal T6. The output signal of logic "1" sets all the bits of the channel for the timing signal T6 in the 9-bit counter through the OR gates 194. This is because the amplitude level of the piano envelope is set to zero upon energization of the electronic musical instrument so as to inhibit generation of piano tones.

Thereafter, when a tone production enable signal PKO is generated so as to generate a piano tone, the signal PKO is differentiated by a differentiator 218. An output from the differentiator 218 causes an AND gate 220 to generate an output signal of logic "1" in response to the timing signal T6. The output signal of logic "1" is supplied to the shift register of the 9th bit of the first stage of the shift register circuit 84 through the 9th bit OR gate among the OR gates 194. At the same time, the output signal of logic "1" serves to disable AND gates 176 to set all the inputs A1 to A9 to the full adder 82 at logic "0".

As a result, at the rise time of the tone production enable signal PKO, the logic level of the 9th bit of the channel for the timing signal T6 in the 9-bit counter becomes "1". At the same time, bits from the LSB through the 8th bit are set at logic "0". The data "00000001" consisting of the second to ninth bits of the 9-bit counter is supplied as the envelope data D2 to D9 to the circuit of FIG. 7 through the shift register circuit 84 in response to the timing signal T0.

In response to the next timing signal T6, the output signal of logic "0" is generated from the shift register of the 8th bit of the 8th stage of the shift register circuit 84. This output signal "0" is supplied as a frequency switching signal FC to a selector 222 of FIG. 7.

Referring to FIG. 7, a latch circuit 224 latches the envelope data D2 to D9 and the tone source signal TG (i.e., the output from the shift register 214) in response to an output signal from an AND gate 228 for receiving the timing signal T0 and the clock signal $\phi 2$. A latch circuit 224 generates the MSB (corresponding to the signal D9) data of logic "1" as 8-bit envelope data at the leading edge of the tone production enabling signal PKO. The respective bits of this data are supplied to a NAND gate 230 which then generates an output signal of logic "1". The output signal "1" is latched by a latch circut 232 in response to the timing signal T2 and is supplied to an AND gate 234. For this reason, the AND gate 234 generates an output signal of logic "1" in response to the signals T6 and $\phi$A. This output signal from the AND gate 234 is supplied as the enable signal EN to the selector 222.

When the selector 222 is rendered operative in response to the enable signal EN, the selector 222 receives the high-speed clock signal $\phi$H as the input B in response to the selection signal SA="1" as the frequency switching signal FC. The high-speed clock signal $\phi$H is supplied as the carry input Ci to the full adder 82 through the OR gates 114 and 116 of FIG. 6. For this reason, the channel for the timing signal T6 in the 9-bit counter is changed such that its count is incremented at a relatively high speed in response to the high-speed clock signal $\phi$H.

When the count is incremented in this manner, the output signal of logic "1" is generated from the shift register of the 8th bit of the 8th stage of the shift register circuit 84. This output signal is supplied as the frequency switching signal FC to the selector 222 of FIG. 7. The selection signal SA from the selector 222 is set at logic "1", so that the selector 222 selects the low-speed clock signal $\phi$L as the input A. Therefore, the channel for the timing signal T6 in the 9-bit counter is changed such that its count is incremented at a relatively low speed in response to the low-speed clock signal $\phi$L. When all the outputs of the 2nd to 7th bits of the 9-bit counter are set at logic "1", the eight input bits of the NAND gate 230 of FIG. 7 are set all at logic "1", so that the NAND gate 230 generates an output signal of logic "0". The selector 222 is disabled in response to the output signal from the NAND gate 230, the timing signal T6 next to the timing signal T2, and the clock signal $\phi$A. Therefore, incrementing for the channel of the timing signal T6 of the 9-bit counter is inhibited.

The respective count data corresponding to changes in counts of the 9-bit counter are supplied as the envelope data D2 to D9 to an inverter 236 through the latch circuit 224. Each bit of the envelope data D2 to D9 is inverted by an exclusive OR gate individually. This inversion operation is performed to invert a change from "00000001" through to "11111111" into a change from "11111111" through to "00000000". Such inversion corresponds to a change in piano envelope from an inverted shape to a normal shape.

The inverter 236 performs inversion in response to a signal $\overline{TC2}$ which is supplied form an OR gate 240 and which is obtained by inverting a timing signal TC2 by an inverter 238. In other words, the inverter 236 generates the envelope data inverted thereby in a duration between the timing signals T0 and T3, i.e., during the "0" logic state internal of the timing signal TC2.

The envelope data sequentially generated as described above are increased from the zero level to a predetermined attack level and are decreased to a predetermined value in accordance with a relatively steep decay curve, thus representing the piano envelope. It should be noted that the zero level corresponds to all "0" outputs K1 to K7 from the inverter 236 (i.e., all "1" bit signals D2 to D8), and that the predetermined value corresponds to the outputs K1 to K7 wherein only the output K7 is set at logic "0" (i.e., only the signal D8 among the signals D2 to D8 is set at logic "1"). It should also be noted that the relatively steep decay curve is represented by the counting operation of the high-speed clock signals $\phi$H, and that the relatively moderate decay curve is represented by the counting operation of the low-speed clock signals $\phi$L.

An AND gate 242 receives an output signal from the NAND gate 230, the tone source signal TG and the output signal TC2 from the inverter 238. During envelope data generation processing, the AND gate generates the tone source signal TG in the duration between the timing signals T0 and T3, i.e., the "0" period of the timing signal TC2. The tone source signal TG is supplied to an AND gate 246 through an OR gate 244.

A shifter 248 performs bit shift processing in response to a control input A, B or C so as to perform D/A conversion (to be described later) by using a minimal number of bits. When the control input A is set at logic "1", the shifter 248 generates the outputs K3 to K8 generated from the inverter 236. When the control input B is set at logic "1", the shifter 248 generates the outputs K2 to K7 generated from the inverter 236. When the control input C is set at logic "1", the shifter 248 generates the outputs K1 to K6 generated from the inverter 236. During piano tone generation processing, the signal D9 is always set at logic "1" as previously described, so that the output K8 from the inverter 236 is always set at logic "0". The control input A comprising the output K8 is set at logic "0". For this reason, the shifter 248 performs shift processing in accordance with the logic level of the control input B or C.

In a circuit for generating the control input B, an AND gate 288 receives an output from an inverter 290 for inverting the output K8 from the inverter 236, the output K7 from the inverter 236 and the timing signal TC0. The AND gate 288 detects that the second highest bit K7 is set at logic "1" (i.e., the amplitude level is relatively high). The AND gate 288 then generates output signals of logic "1" in response to the timing signals T1 and T3 in the duration between the timing signals T0 and T3, respectively. These output signals from the AND gate 288 are supplied as the control input B to the shifter 248. The shifter 248 generates 6-bit (K2 to K7) data as the envelope data EV twice in a duration between the timing signals T0 and T3.

In a circuit for generating the control input C, an AND gate 292 receives the output from the inverter 290, an output from an inverter 294 for inverting the output K7, and the timing signals TC0 and TC1. The AND gate 292 detects that the second highest bit K7 is set at logic "0" (the amplitude level is relatively low) and generates an output signal of logic "1" in response to the timing signal T3 in a duration between the timing signals T0 and T3. The output signal of logic "1" is supplied as the control input C to the shifter 248. The shifter 248 generates 6-bit (K1 to K6) data as the envelope data EV once in a duration between the timing signals T0 and T3.

An OR gate 296 receives the output K8 from the inverter 236, the output from the AND gate 288 and the output from the AND gate 292. When K7="1" is detected in a duration between the timing signals T0 and T3, the OR gate 296 generate output signals of logic "1" in response to the timing signals T1 and T3. However, when K7="0" is detected, the OR gate 296 generates an output signal of logic "1" in response to the timing signal T3. The output signal of logic "1" from the OR gate 296 enables the AND gate 246, so that the tone source signal TG from the OR gate 244 is generated in synchronism with the envelope data generated from the AND gate 246 once or twice in the duration between the timing signals T0 and T3.

The tone source signal TG from the AND gate 246 and the envelope data EV from the shifter 248 are supplied to the D/A converter 36 shown in FIG. 8.

The D/A converter 36 comprises: a first decoder 298 for decoding the upper two bits of the 6-bit input (EV or AM); a second decoder 300 for decoding the remaining four bits of the input data; an analog voltage generator 302 constituting the D/A converter together with the decoders 298 and 300; a power source circuit 304 for supplying a power source voltage corresponding to the control input (TG or SG) to the analog voltage generator 302; a pulse width limiting circuit 306 for limiting the pulse width of the output voltage from the analog voltage generator 302 in response to the clock signals $\phi$1 and $\phi$2; and a buffer amplifier 308 for amplifying a voltage output VOUT from the pulse width limiting circuit 306.

The upper two-bit signal including the MSB in the 6-bit envelope data EV is supplied to the decoder 298, and the remaining 4-bit signal is supplied to the decoder 300. Four output lines of the decoder 298 are connected to control input terminals of gate elements GA1 to GA4 in the analog voltage generator 302, respectively. The analog voltage generator 302 has four gate element groups G1 to G4 each of which includes 16 gate elements. 16 output lines of the decoder 300 are connected to the control input terminals of the 16 gate elements of each gate circuit, respectively.

The analog voltage generator 302 has first and second power source lines PS1 and PS2. 64 resistors R1 to R64 are connected in series with each other between the first and second power source lines PS1 and PS2. Each of the 16 gate elements of the gate element group G1 is connected to one end of a corresponding one of the resistors R1 to R16 and the gate element GA1. Each of the 16 gate elements of the gate element group G2 is connected to one end of a corresponding one of the resistors R17 to R32 and the gate element GA2. Each of the 16 gate elements of the gate element group G3 is connected to one end of a corresponding one of the resistors R33 to R48 and the gate element GA3. Each of the 16 gate elements of the gate element group G4 is connected to one end of a corresponding one of the resistors R49 to R64 and the gate element GA4. The gate elements GA1 to GA4 generate an analog voltage corresponding to the input data at an output point M.

In the power source circuit 304, a resistor R0 and resistors RA and RB having substantially the same resistance are connected in series with each other between a voltage source +V and the reference potential point (ground potential). An intermediate voltage VC appearing at the common junction between the resistors RA and RB is supplied to the power source line PS1. A gate element GH is connected between the common junction between the resistors R0 and RA and the power source line PS2. A gate element GL is connected between the reference potential point and the power source line PS2. The control input terminal of the gate element GL receives the tone source signal TG or the sign bit signal SG. The control input terminal of the gate element GH receives signals from an inverter IV for inverting the tone source signal TG or the sign bit signal SG. For this reason, the power source line PS2 receives a voltage VL lower than the intermediate voltage VC through the gate element GL when the control input (TG or SG) is set at logic "1". However, when the control input is set at logic "0", a voltage VH higher than the intermediate voltage VC is supplied to the power source line PS2 through the gate GH. In this manner, the voltage VL or VH is selectively supplied to the power source line PS2, so that an envelope represented by the envelope data can be added to the tone source signal TG during D/A conversion. During D/A conversion of amplitude data (to be described later), the direction (sign) of the amplitude can be determined in accordance with the sign bit signal SG.

The pulse width limiting circuit 306 includes gate elements G11 and G12 for receiving the clock signals $\phi 1$ and $\phi 2$ at the control input terminals thereof, respectively. The gate elements G11 and G12 are connected in series with each other between the output point M of the analog voltage generator 302 and the common junction between the resistors RA and RB in the power source circuit 304. The voltage output VOUT is generated from the common junction N between the gate elements G11 and G12 through the buffer amplifier 308. Although an analog voltage (a voltage increased from VC to VH or decreased from VC to VL) may appear at the output point M in response to one pulse of the timing pulses T0 to T7, the pulse width limiting circuit 306 generates the analog voltage at the output point M in response to the clock signal $\phi 1$ and the intermediate voltage VC in response to the clock signal $\phi 2$, thereby limiting the pulse width of the output pulse to half of that appearing at the output point M.

The reason why the pulse width limiting circuit 306 is arranged is that the 8-bit (K1 to K8) input data is not directly D/A converted but is translated to 6-bit data (EV/AM) which is then subjected to D/A conversion. More particularly, referring to FIG. 7, when the 6-bit data is extracted through the shifter 248, the data K2 to K7 and the data K3 to K8 are shifted low by one bit and two bits with respect to the data K1 to K6, respectively. The value of the data K2 to K7 is $\frac{1}{2}$ of that of the data K1 to K6, and the value of the data K3 to K8 is $\frac{1}{4}$ of that of the data K1 to K6. In the D/A converter shown in FIG. 8, D/A conversion must be performed to increase the amplitude level of the data K2 to K7 twice and of the data K3 to K8 four times. In order to achieve such D/A conversion, the data K2 to K7 and the data K3 to K8 are generated twice and four times, respectively, from the circuit of FIG. 7. At the same time, in the pulse width limiting circuit 306 of FIG. 8, the identical analog voltage is supplied as two pulses corresponding to the data generated twice and as four pulses corresponding to the data generated four times.

Figures 9A, 9B, 9C, 9D:
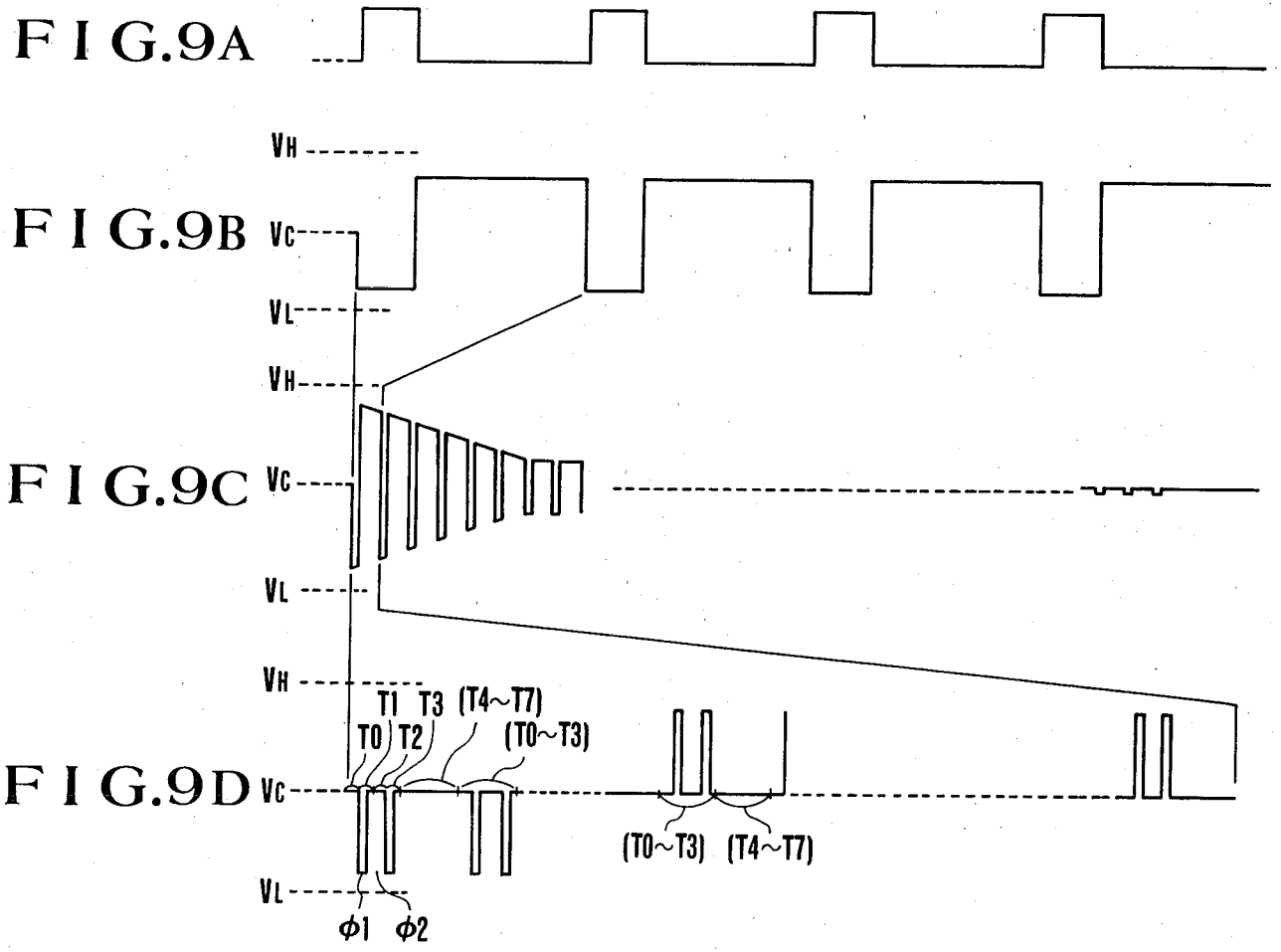
FIGS. 9A and 9D are respectively timing charts for explaining D/A conversion when piano tones are to be generated.

The above D/A conversion as applied to piano tone generation is as shown in FIGS. 9A to 9D. FIG. 9A shows a continuous waveshape of the tone source signal TG for illustrative convenience; FIG. 9B shows a continuous waveshape of the tone source signal added with the piano envelope; FIG. 9C macroscopically shows part of the signal shown in FIG. 9B; FIG. 9D microscopically shows part of the signal of FIG. 9C and represents a signal actually appearing at the output point N in the pulse width limiting circuit 306.

An analog voltage corresponding to the attack level appears at the output point M at the leading edge of the piano envelope. This analog signal has an amplitude near that of the voltage VL with respect to the voltage VC when the tone source signal TG is set at logic "1". However, when the tone source signal TG is set at logic "0", the analog signal has an amplitude near that of the voltage VH with respect to the voltage VC. When the analoig signal is considered with respect to the output point N, as shown in FIG. 9D, the voltage near the voltage VL or VH is generated as two pulses in response to the timing signals T1 and T3 in the duration between the timing pulses T0 and T3. When the amplitude level of the piano envelope is lowered below a level where the second highest bit K7 is set at logic "0", the pulse generated in the duration between the timing pulses T0 and T3 comprises only one pulse which is generated in response to the timing pulse T3.

As a consequence, the tone source signal with the envelope, as shown in FIGS. 9A to 9D, is generated as the voltage output VOUT from the buffer amplifier 308. This tone source signal is supplied to the loudspeaker 40 from the output amplifier 38 with or without being passed through a low-pass filter, and the piano tone is produced at the loudspeaker 40. In this case, the high-frequency component based on time division processing and the clock signals $\phi 1$ and $\phi 2$ is removed by the low-pass filter or the loudspeaker 40. Therefore, the piano tone actually produced at the loudspeaker 40 comprises the piano tone signal shown in FIG. 9B. This piano tone signal includes two pulses at the attack level and a relative high amplitude level near the attack level in the duration between the timing pulses T0 and T3. As compared with the case wherein only one pulse is included, the energy of the piano tone signal including the two pulses is doubled, and the volume is also doubled. Therefore, an amplitude decrease caused by bit shifting can be recovered.

DETAIL OF SPEECH VOICE GENERATION OPERATION

As previously described, the time division processor 24 performs time division operations: (C1) address data generation processing; (C2) step width data generation processing; and (C3) predictive value data generation processing. The relationship between the timing signals T0 to T7 and the processing and output timings is summarized in Table 3 below.

TABLE 3

| Processing Content | Processing Timing | Output Timing |
|---|---|---|
| C1 | T3 | T5 |
| C2 | T1 | None |
| C3 | T2 | T4 |

According to Table 3, l the delay of the output timings with respect to the processing timings is the same as that of Table 1. The step width data generated by processing (C2) is obtained together with the predictive value obtained by processing (C3) in response to the timing signal T2. These data will not be generated from the time division processor 24.

Referring to FIG. 6, the full adder 82 and the shift register circuit 84 are used as a 12-bit address counter in response to the timing signal T3 which generates address data D1 to D12 for human voice data readout. The full adder 82 performs an addition or subtraction in response to the timing signals T1 and T2.

Referring to FIG. 4, a differentiator 310 differentiates the leading edge of the tone production enabling signal DKO for speech voice generation. The differentiated output sets an R-S flip-flop 312. An output $\overline{Q}$ from the flip-flop 312 is set at logic "0". This output is supplied to an AND gate 316 through a shift register 314.

Since the AND gate 316 receives the timing signals T1, T2 and T3 generated from an OR gate 318, the gate 316 generates output signals of logic "0" in response to the timing signals T1, T2 and T3, respectively. These output signals are sequentially supplied to the full adder 82 of FIG. 6 through the OR gate 152. Therefore, the full adder 82 is set in response to the timing signals T1, T2 and T3.

The channel for the timing signal T3 in the address counter is reset, and then the address counter starts counting. More particularly, an AND gate 320 receives the timing signal $\phi A+\phi B$ and generates an output signal of logic "1" in response to the timing signal T3. This output signal is supplied as the carry input Ci to the full adder 82 through the OR gates 114 and 116, so that the channel for the timing signal T3 in the address counter is incremented upon reception of every carry input Ci. The count data from the shift register circuit 84 is supplied as address data D1 to D12 to a latch circuit 322 of FIG. 10 in response to the timing signal T5. The latch circuit 322 performs latching in response to the output signal from an AND gate 324 for receiving the timing signal T5 and the clock signal $\phi 2$. In this manner, the latch circuit 322 latches the address data in response to the signals T5 and $\phi 2$.

A human voice data memory 326 comprises, for example, a ROM and stores human voice data (serial data) reciting names of fifteen notes $F_3$ through $F_5$, as previously described. The parallel human voice data of fifteen notes are read out from the human voice data memory 326 in response to the corresponding address data. In addition, the human voice data is read out in a bit serial form in units of notes. The readout data is supplied to a selector 328.

A decoder 330 decodes the pitch data KPC or MPC, and a decoded output is supplied to the selector 328.

The selector 328 selects the human voice data corresponding to the speech voice represented by the output from the decoder 330. The selected human voice data is supplied to a latch circuit 332 and latched in response to the timing signal T5.

The human voice data having the bit serial form and generated from the latch circuit 332 is supplied to a three-same-state detection circuit 334, a delay circuit 336 and one input terminal of an exclusive OR gate 338. The delay circuit 336 comprises a two-phase shift register for receiving the input in response to the timing signal T22 and generating the delayed output in response to the timing signal T5. An output signal from the two-phase shift register is supplied to the other input terminal of the exclusive OR gate 338. For this reason, the exclusive OR gate 338 generates an output signal of logic "0" when two consecutive bits are both set at logic "0" or "1". Otherwise, the exclusive OR gate 338 generates an output signal of logic "1".

The output signal from the exclusive OR gate 338 is supplied to one input terminal of an OR gate 340 and a delay circuit 342. The delay circuit 342 has the same arrangement as that of the delay circuit 336. An output signal from the delay circuit 342 is supplied to the other input terminal of the OR gate 340. For this reason, the OR gate 340 generates an output signal of logic "0" when the output signals from the exclusive OR gate 338 and the delay circuit 342 are set at logic "0", i.e., when three consecutive bits are all set at "0". Otherwise, the OR gate 340 generates an output signal of logic "1".

The reason why the three-same-state detection circuit 334 is arranged is that the step width (more particularly, the step width is increased when three consecutive bits are all "0" or "1") can be changed in accordance with the state of the human voice data.

An AND gate 344 receives the timing signal T1 and the clock signal $\phi A+\phi B$ and generates an output signal as a timing signal TM1. The output signal is supplied as an output signal SO1 through an OR gate 346. An AND gate 348 is enabled to gate the output signal from the three-same-state detection signal 334 in response to the output signal from the AND gate 344 receiving the timing signal T1 and the clock signal $\phi A+\phi B$. An output signal from the AND gate 348 is obtained as an output signal SO2 through an OR gate 350.

An AND gate 352 receives the timing signal T2 and the clock signal $\phi A+\phi B$ and generates an output signal as a timing signal TM2. In response to the output signal from the AND gate 352 receiving the timing signal T2 and the clock signal $\phi A+\phi B$, an AND gate 354 is enabled to gate the human voice data of the bit serial form which is generated from the latch circuit 332. This human voice data is supplied as the output signal SO1 through the OR gate 346 and as the output signal SO2 through the OR gate 350. The timing signals TM1 and TM2 and the output signals SO1 and SO2 are supplied to the circuit of FIG. 6.

The circuit of FIG. 6 performs step width data formation processing in response to the timing pulse T1. Such processing is performed in accordance with the signals TM1, SO1 and SO2 described with reference to FIG. 10. In this case, the signals TM1 and SO1 comprise an output signal T1.($\phi A+\phi B$) from the AND gate 344 of FIG. 10. The signal SO2 comprises the output signal from the three-same-state detection signal shown in FIG. 10.

The step width calculation is performed in cases (A) and (B) as follows:

(A) When logic "0" or "1" continues in serial human voice data bits (i.e., a change in amplitude is large):

$$\Delta t = \Delta t - 1 + (\Delta max - \Delta t - 1)/n \quad (1)$$

(B) Otherwise, $$\Delta t = \Delta t - 1 - (\Delta t - 1)/n \quad (2)$$

where

Δt: the step width to be calculated at present

Δt−1: the immediately preceding step width

Δmax: the maximum value of the step width n: the constant regarded as a time constant in units of sampling periods so as to determine the speed of change in step width In the above embodiment, when three consecutive bits are all "0" or "1", equation (1) can be rewritten as equation (3). Otherwise, equation (2) can be rewritten as equation (4) (i.e., two's complement calculation):

$$\Delta t = \Delta t - 1 + \overline{(\Delta t - 1)}/n \quad (3)$$

$$\Delta t = \Delta t - 1 + \overline{(\Delta t - 1)}/n + 1 \quad (4)$$

Referring to FIG. 6, six selectors 356 can select inputs B in response to the selection signal b as the timing signal TM1 at the timings of the signals T1 and $\phi A + \phi B$. For this reason, the upper 6-bit data (corresponding to S7 to S12) in the immediately preceding step width data generated from the 8th stage of the shift register circuit 84 is supplied to exclusive OR gates 358 through the selectors 356 and the AND gates 176 and is subjected to inversion operation in response to the signal So1="1". The 6-bit data (inverted data) from the exclusive OR gates 358 is supplied as inputs B1 to B6 to the full adder 82 through the OR gates 168. In this case, inputs A1 to A12 to the full adder 82 comprise the immediately preceding step width data from the 8th stage of the shift register 84.

Under this condition, when the three-same-state detection circuit 334 detects that three consecutive bits are all set at "0" or "1", the signal SO2 is set at logic "0", so that the carry input Ci and the inputs B7 to B12 to the full adder 82 are all set at "0". Therefore, the calculation is performed in accordance with equation (3). However, when the three-same-state detection circuit 334 does not detect that three consecutive bits are all set at at "0" or "1", the signal SO2 is set at logic "1" which is supplied as the carry input to the full adder 82 through the OR gates 114 and 116. The signal SO2 of logic "1" is also supplied as the inputs B7 to B12. In this case, the calculation is performed in accordance with equation (4). It should be noted that the constant n is $2^6$ since the upper six bits has been shifted downward by 6 bits.

When three consecutive bits are all set at "0" or "1" (i.e., when the amplitude is rapidly decreased or increased), the step width is increased. However, when logic "0" and "1" are alternately repeated (i.e., when the amplitude change is relatively moderate), the step width is decreased. Therefore, the precision of the predictive signal for the tone source signal can be improved.

In the circuit of FIG. 6, predictive data generation is performed in response to the timing signal T2. This processing is performed in accordance with the signals TM2, SO1 and SO2 described with reference to FIG. 10. In this case, the signal TM2 comprises an output signal T2.($\phi A + \phi B$) from the AND gate 352 shown in FIG. 10, and the signals SO1 and SO2 comprise the serial human voice data from the AND gate 354.

The predictive value calculation is performed in accordance with equation (5) when the signals SO1 and SO2 (serial human voice data) are both set at logic "0". When the signals SO1 and SO2 are both set at logic "1", the predictive value calculation is performed in accordance with equation (6).

$$St = St - 1 + \Delta t - 1 \quad (5)$$

$$St = St - 1 + \Delta t - 1 \quad (5)$$

$$St = St - 1 - \Delta t - 1 \quad (6)$$

$$= St - 1 + \overline{(\Delta t - 1)} + 1$$

where

St: the predictive value to be calculated at present

St−1: the immediately preceding predictive value t−1: the immediately preceding step width Referring to FIG. 6, the six selectors 356 select the input A in response to the selection signal a as the timing signal TM2 in response to the signals T2 and $\phi A + \phi B$.

When the signals SO1 and SO2 are both set at logic "0", the upper six bit data (corresponding to S7 to S12) in the immediately preceding step width data from the first stage of the shift register circuit 84 is supplied as the inputs B1 to B6 to the full adder 82 through the selectors 356, the exclusive OR gates 358 and the OR gates 168. In this case, the inputs A1 to A12 to the full adder 82 comprise the immediately preceding predictive value data from the 8th stage of the shift register circuit 84. Since the signal SO1 is set at logic "0", the exclusive OR gates 358 do not perform inversion. The carry input Ci and the inputs B7 to B12 to the full adder 84 are all set at "0" since the signal SO2 is set at logic "0". Therefore, the calculation is performed in accordance with equation (5).

When the signals SO1 and SO2 are both set at logic "1", the upper 6-bit data (corresponding to S7 to S12) in the immediately preceding step width data generated from the first stage of the shift register 84 is supplied as the inputs B1 to B6 to the full adder 82 through the selectors 356, the exclusive OR gates 358 and the OR gates 168. In this case, since the signal SO2 is set at logic "1", the exclusive OR gates 358 perform inversion. The carry input Ci and the inputs B7 to B12 to the full adder 82 are all set at logic "1" in response to the signal SO2="1". Furthermore, the inputs A1 to A12 to the full adder 82 comprise the immediately preceding predictive value data generated from the 8th stage of the shift register 84. Therefore, the calculation (two's complement calculation) is performed in accordance with equation (6).

An AND gate A0, OR gates O1 and O2 and an inverter I are arranged to set a minimum step width. When upper five bits (corresponding to S8 to S12) in the 6-bit step width data are all set at logic "0", an output signal from the OR gate O1 is set at logic "0". This output signal disables the AND gate A0 and is inverted by the inverter I to a signal of logic "1". The signal of logic "1" is then supplied to the OR gate O2. Therefore, the step width data generated through the selectors 356 comprises a bit string "010000" in which the leftmost bit is the LSB.

The 9-bit predictive value data D2 to D10 of each sampling point are generated from the shift register circuit 84 in response to the timing signal T4 in accordance with the step width and predictive value operations described above. The 9-bit predictive value data are then supplied to the circuit of FIG. 7.

In the circuit of FIG. 7, the predictive value data D2 to D10 are latched by a latch circuit 224 in response to the timing signal T4 and the clock signal $\phi 2$. The latched data comprises the two's complement code data. The bit corresponding to the data D10 comprises the sign bit. The sign bit signal SG is supplied to an AND gate 360 and is logically ANDed with the timing signal TC2. The AND gate 360 is enabled for a duration between the timing signals T4 and T7, i.e., during the "1" level period of the timing signal TC2, and generates the sign bit signal SG. The sign bit signal SG is supplied to the AND gate 246 through the OR gate 244.

The sign bit signal SG from the AND gate 360 is supplied to the inverter 236 through the OR gate 240 and is used for code conversion processing. More particularly, when the sign bit signal SG is set at logic "0", the inverter 236 generates the 8-bit data (corresponding to D2 to D9) from the latch circuit 224 without inversion. However, when the sign bit signal SG is set at logic "1", the inverter 236 inverts the 8-bit data from the latch circuit 224 and adds 1 to the LSB, thereby generating the resultant signal. Therefore, the inverter 236 converts the two's complement code to a sign magnitude code comprising 8-bit (K1 to K8) data. This 8-bit data is supplied to the shifter 248.

The shifter 248 generates the data in accordance with one of the operating modes corresponding to the logic state of the control inputs A, B and C, as described with reference to piano tone generation. The data generation from the shifter 248 is performed in synchronism with generation of the sign bit signal SG from the AND gate 246.

The control input A is set at logic "1" when the output K8 (MSB) from the inverter 236 is set at logic "1". When the control input A goes high, the shifter 248 continuously generates as the amplitude data the 6-bit (K3 to K8) data from the inverter 236 for the duration between the timing signals T4 and T7. In addition, the output K8="1" enables the AND gate 246 through the OR gate 296, so that AND gate 246 continuously generates the sign bit signal SG from the OR gate 244 for the duration between the timing signals T4 and T7.

The control input B comprises the output signal from the AND gate 288. This output signal is set at logic "1" in response to the timing signals T5, T7 and the TC0 when the output K8 is set at logic "0" and the output K7 is set at logic "1". For this reason, the shifter 248 generates the 6-bit (K2 to K7) data on the basis of the control input B="1" twice in response to the timing signals T5 and T6 in the duration between the timing signals T4 and T7. Furthermore, since the output signal of logic "1" from the AND gate 288 enables the AND gate 246 through the OR gate 296, the sign bit signal SG from the OR gate 244 is generated twice in response to the timing signals T5 and T7 in the duration between the timing signals T4 and T7.

The control input C comprises the output signal from the AND gate 292. This output signal is set at logic "1" when the outputs K7 and K8 are both set at logic "0". For this reason, the shifter 248 generates the 6-bit (K1 to K6) data as the amplitude data AM on the basis of the control input C="1" in response to the timing signal T7 for the duration between the timing signals T4 and T7. The output signal from the AND gate 292 enables the AND gate 246 through the OR gate 298. The AND gate 246 generates, in response to the timing signal T7 for the duration between the timing signals T4 and T7, the sign bit signal SG generated from the OR gate 244.

The 6-bit amplitude data AM and the sign bit signal SG generated for each sampling point, as described above, are supplied to the circuit shown in FIG. 8.

In the circuit of FIG. 8, the upper two-bit signal in the amplitude data AM is supplied to the first decoder 298, and the remaining 4-bit signal is supplied to the second decoder 300. The sign bit signal SG is supplied as the control input directly to the gate element GL but is supplied as the control input to the gate element GH through the inverter IV. For this reason, the analog voltage corresponding to the input amplitude data AM appears at the output point M in the analog voltage generator 302.

Figure 11:
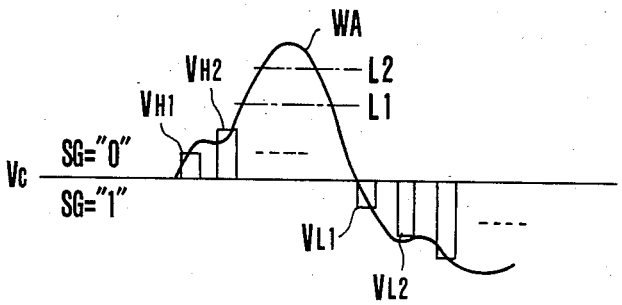
FIG. 11 is a timing chart of a signal for explaining D/A conversion when a speech signal is to be generated.

The analog voltage generated as described above is a positive voltage VH1 or VH2 with respect to the intermediate voltage VC when the sign bit signal SG is set at logic "0", as shown in FIG. 11. However, when the sign bit signal SG is set at logic "1", the analog voltage is a negative voltage VL1 or VL2 with respect to the intermediate voltage VC. Referring to FIG. 11, reference symbol WA denotes an analog predictive signal waveshape comprising voltages VH1, VH2, . . . and VL1, VL2 . . . sequentially appearing at the output point M.

The analog voltage at the output point M is converted by the pulse width limiting circuit 306 to one, two or four pulses in accordance with the output timings. In this case, the pulse conversion operation is performed by alternately switching the gate elements G11 and G12 in response to the clock signals $\phi 1$ and $\phi 2$, as previously described with reference to piano tone generation. The pulse width limiting circuit 306 generates one pulse when the analog voltage is generated in response to the timing signal T7 for the duration between the timing signals T4 and T7 of FIG. 9D. Two pulses are generated when the analog voltage is generated twice in response to the timing signals T5 and T7. Four pulses are generated when the analog voltage is generated four times in response to the timing signals T4, T5, T6 and T7. Referring to FIG. 11, the analog voltage (corresponding to the data K1 to K6 of FIG. 7) having a level lower than the level L1 is generated as one pulse in response to the timing signal T7. The analog voltage (corresponding to the data K2 to K7 of FIG. 7) having a level between the level L1 and the level L2 is generated as two pulses in response to the timing signals T5 and T7. The analog voltage (corresponding to the data K3 to K8 of FIG. 7) having a level higher than the level L2 is generated as four pulses in response to the timing signals T4, T5, T6 and T7.

As a result, the pulse width limiting circuit 306 generates a negative or positive pulse string with respect to the intermediate voltage VC, thereby generating a predictive signal corresponding to, for example, speech "do". This predictive signal is supplied to the buffer amplifier 308, the output amplifier 38 (FIG. 1) and then the loudspeaker 40, as previously described with reference to piano tone generation, and is produced as a speech voice. In this case, the volume of a portion of the predictive signal which includes two pulses for a duration between the timing signals T4 and T7 is double compared with the portion including only one pulse. The volume of a portion of the predictive signal which includes four pulses for a duration between the timing signals T4 and T7 is four times, thereby recovering an amplitude decrease caused by bit shifting.

Figure 10:
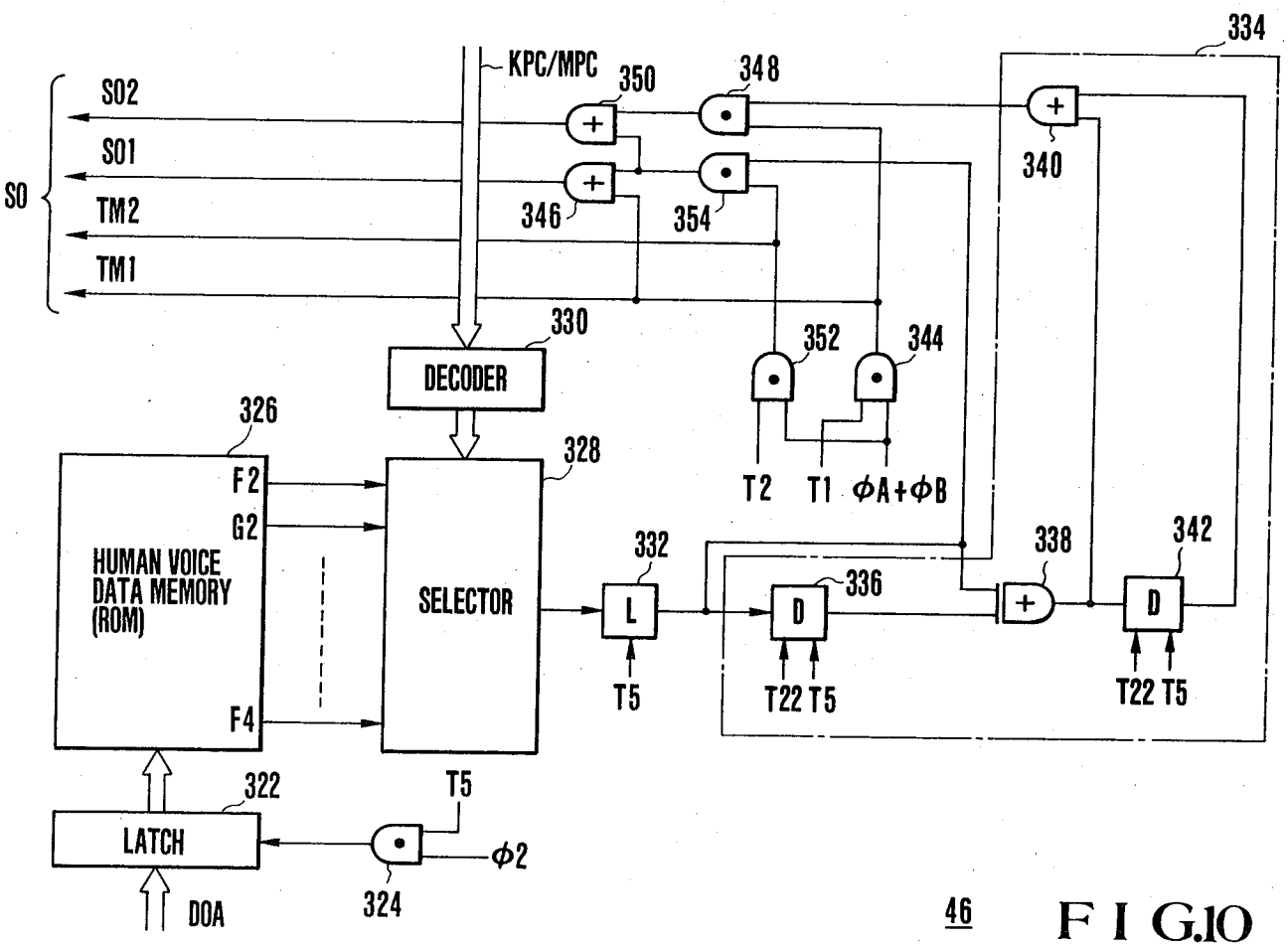
FIG. 10 is a circuit diagram of a human voice data generator in the electronic musical instrument shown in FIG. 1.

Referring to FIG. 6, when the output S12 from the full adder 82 is set at logic "1" in response to the timing signal T3, an AND gate 362 generates an output signal of logic "1". This output signal is supplied as a read end signal SRE to the circuit of FIG. 4 to reset the flip-flop 312 through a shift register 364. For this reason, the output $\overline{Q}$ from the flip-flop 312 is set at logic "1" and is supplied to the AND gate 316 through a shift register 314. The AND gate 316 sequentially generates the output signals of logic "1" in response to the timing signals T1, T2 and T3 generated from the OR gate 318. These signals of logic "1" are supplied as the reset signal RST to the full adder 82 through the OR gate 152. As a result, the full adder 82 is sequentially reset in response to the timing signals T1, T2 and T3 after the address data representing the end read address for the human voice data memory 326 of FIG. 10 is read out, thereby completing generation for one speech tone. Thereafter, every time the tone production enabling signal DKO for speech tone generation is generated, the speech tone generation described above is performed.

According to the present invention, a multiplexing means is provided for time-divisionally performing musical tone signal production and human voice signal production to generate a musical tone and/or a human voice tone, thereby providing an electronic musical instrument suitable for musical education of children. Since the human voice speech can be generated in addition to the musical tone, these tones can be generated in the manual or automatic mode, thereby providing a multifunctional electronic musical instrument which children will not be tired of playing. In addition, the electronic musical instrument of the present invention is operated with time division multiplexing, so that the number of components can be decreased and the circuit can be constituted by an IC, thereby realizing a compact low-cost electronic musical instrument.

The present invention is not limited to the above embodiment. Various changes and modifications may be made within the spirit and scope of the invention. In the above embodiment, the adaptive delta modulation system is used for storing the human voice data generation circuit memory. However, any known system can be used in place of the adaptive data modulation system.

What is claimed is:

1. An electronic musical instrument comprising:

musical tone designating means for designating a musical tone to be produced;

human voice data designating means for human voice data associated with the designated musical tone;

multiplexing means for time-divisionally processing the designated musical tone and the human voice data; and means for producing the musical tone and the human voice in accordance with an output from said multiplexing means; means for generating an envelope of the designated musical tone wherein the envelope comprises digital waveshape data;

a digital/analog converter having a digital input terminal, an analog output terminal and a power source terminal; and a power source circuit having a control input terminal and a power source supply terminal connected to the power source terminal, the digital input terminal of said digital/analog converter being adapted to receive the digital waveshape data representing the envelope of the designated musical tone, and the control input terminal being adapted to receive a control signal corresponding to a frequency of the designated musical tone;

wherein the digital waveshape data comprises n bits, and further comprising:

converting means for converting n-bit digital waveship data to m-bit (where m n) digital waveshape data;

a digital/analog converter for converting the m-bit digital waveshape data generated from said converting means to an analog signal; and gate means arranged at an output side of said digital-/analog converter said converting menas including means for selecting out of said n-bit digital waveshape data m-bit data consisting of consecutive m bits beginning with the bit which is next to consecutive "0"s within top l bits of the n-bit digital waveshape data and downward bits therefrom, and said gate means including control means for controlling on ON time of a gate in accordance with the number of said consecutive "0"s.

2. An electronic musical instrument according to claim 1, wherein the l bits are defined as follows:

$$l=n-m-1.$$

3. A digital wave to analog wave converting apparatus comprising:

converting means for converting n-bit digital waveship data to m-bit (where $M<n$) digital waveshape data;

a digital/analog converter for converting the m-bit digital waveshape data generated from said converting means to an analog signal; and gate means arranged at an output side of said digital-/analog converter, said converting means including means for selecting out of said n-bit digital waveshape data m-bit data consisting of consecutive m bits beginning with the bit which is next to consecutive "0"s within top l bits of the n-bit digital waveshape data and downward bits therefrom, and said gate means including control means for controlling an ON time of a gate in accordance with the number of said consecutive "0"s.

4. An apparatus according to claim 3, wherein the l bits are defined as follows:

$$l=n-m-1.$$

5. An apparatus according to claim 3, wherein said control means controls the ON time of said gate in proportion to $2^i$ where i is the number of said consecutive "0"s.

* * * * *

UNITED STATES PATENT AND TRADEMARK OFFICE

CERTIFICATE OF CORRECTION

PATENT NO. : 4,733,591

DATED : 03/29/88

INVENTOR(S) : Kaneko et al.

It is certified that error appears in the above-identified patent and that said Letters Patent is hereby corrected as shown below:

| COLUMN | LINE | DESCRIPTION |
|---|---|---|
| 03 | 56 | delete "times" insert --tunes-- |
| 22 | 33 | delete "analoig" insert --analog-- |

Signed and Sealed this

Twenty-fourth Day of January, 1989

*Attest:*

*Attesting Officer*

DONALD J. QUIGG

*Commissioner of Patents and Trademarks*